US011750995B2

(12) United States Patent
Pang et al.

(10) Patent No.: US 11,750,995 B2
(45) Date of Patent: Sep. 5, 2023

(54) METHOD AND APPARATUS FOR PROCESSING A STEREO SIGNAL

(71) Applicant: HUAWEI TECHNOLOGIES CO., LTD., Guangdong (CN)

(72) Inventors: Liyun Pang, Munich (DE); Fons Adriaensen, Munich (DE); Song Li, Hannover (DE); Roman Schlieper, Hannover (DE)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 224 days.

(21) Appl. No.: 17/384,124

(22) Filed: Jul. 23, 2021

(65) Prior Publication Data

US 2021/0352425 A1 Nov. 11, 2021

Related U.S. Application Data

(63) Continuation of application No. PCT/EP2019/051917, filed on Jan. 25, 2019.

(51) Int. Cl.
*H04S 3/00* (2006.01)
*H04S 7/00* (2006.01)

(52) U.S. Cl.
CPC ..... *H04S 3/004* (2013.01); *H04S 7/30* (2013.01); *H04S 2400/05* (2013.01); *H04S 2420/01* (2013.01)

(58) Field of Classification Search
CPC ..... H04S 3/004; H04S 7/30; H04S 2400/05; H04S 2420/01
USPC ..... 381/27
See application file for complete search history.

(56) References Cited

FOREIGN PATENT DOCUMENTS

| | | | |
|---|---|---|---|
| CN | 102172047 | A | 8/2011 |
| WO | 2007080225 | A1 | 7/2007 |
| WO | 2010012478 | A2 | 2/2010 |
| WO | 2015062649 | A1 | 5/2015 |

OTHER PUBLICATIONS

Iida et al., "Median plane localization using a parametric model of the head-related transfer function based on spectral cues," Applied Acoustics, Elsevier Publishing, GB, vol. 68, No. 5, May 5, 2007, XP022061128, pp. 835-850 (Year: 2007).*

Ida et al, Median plane localization using a parametric model of the head-related transfer function based on spectral cues, Applied Acoustics, Elsevier Publishing, GB, vol. 68 No. 8, May 5, 2007, XP022061128, 16 pages.

Faller, C., Breebaart, J., Binaural Reproduction of Stereo Signals Using Upmixing and Diffuse Rendering , AES 131st Convention, Oct. 20-23, 2011 New York, USA, 8 pages.

(Continued)

*Primary Examiner* — Paul Kim
(74) *Attorney, Agent, or Firm* — WOMBLE BOND DICKINSON (US) LLP

(57) ABSTRACT

The disclosure relates to a method for processing a stereo signal. The method can include obtaining a center channel signal by up-mixing the stereo signal. The method can also include generating a filtered center channel signal by applying one or more peak filters and one or more notch filters to the center channel signal. Furthermore, the method can include generating a binaural signal based on the filtered center channel signal.

9 Claims, 19 Drawing Sheets

(56) References Cited

OTHER PUBLICATIONS

Shu-Nung Yao et al, HRTF Adjustments with Audio Quality Assessments, Archives of Acoustics., vol. 38, No. 1, Mar. 1, 2013, XP55630071, 8 pages.
Kim, Y. G., Chun, C. J., Kim, H. K., Lee, Y. J., Jang, D. Y., and Kang, K, An integrated approach of 3D sound rendering techniques for sound externalization, Advances in Multimedia Information Processing, Sep. 2010, 13 pages.
Ming Zhang, KahChye Tan and M.H.Er, A Refined Algorithm of 3D Sound Synthesis, ICSP98, pp. 1408-1411, Singapore, 1998.
N. Gupta, A. Barreto and C. Ordonez, Spectral modification of head-related transfer functions for improved virtual sound spatialization, in IEEE International Conference on Acoustics, Speech, and Signal Processing, USA, 2002, pp. 1953-1956.
Chong-Jin Tan and Woon-Seng Gan, User-defined spectral manipulation of HRTF for improved localization in 3D sound systems, IEEE electronic letters, vol. 34, pp. 2387-2389, Dec. 1998.
M Bou ri, and C. Kyirakakis, Audio signal decorrelation based on a critical band approach, 117th AES Convention, 2004, 6 pages.
G. S. Kendall, The Decorrelation of Audio Signals and Its Impact on Spatial Imagery, Computer Music Journal, vol. 19, pp. 71-87, 1995.
R. Wallis and R. Wallis and H. Lee, Directional Bands Revisited, 138th AES Convention, 2015, 7 pages.
J. Blauert, Sound Localization in the Median Plane, Acustica, vol. 22, pp. 205-213, 1969.
J. Hebrank, D. Wright, Spectral Cues used in the Localisation of Sound Sources on the Median Plane, J. Acoust. Soc. Am. vol. 56, pp. 517-520, 1974.
WS Gan, J He, R Ranjan, R Gupta, ICASSP 2018 Tutorial T11 Natual and Augmented Listening for VR/AR/MR, Apr. 16, 2018, 251 pages.
Blauert, J. (1997) Spatial Hearing: The Psychophysics of Human Sound Localization, The MIT Press, 494 pages.
Bosun Xie (2013) Head-Related Transfer Function and Virtual Auditory Display, J. Ross Publishing"s Acoustic, 504 pages.

* cited by examiner

METHOD AND APPARATUS FOR PROCESSING A STEREO SIGNAL

CROSS-REFERENCE TO RELATED APPLICATIONS

This application is a continuation of International Application No. PCT/EP2019/051917, filed on Jan. 25, 2019, the disclosure of which is hereby incorporated by reference in its entirety.

TECHNICAL FIELD

The present disclosure relates to the field of audio signal processing and reproduction. More specially, the disclosure relates to a method for processing a stereo signal and an apparatus for processing a stereo signal. The present disclosure also relates to a computer-readable storage medium.

BACKGROUND

Three-dimensional (3D) audio effects are a group of spatial sound effects produced by stereo speakers, surround-sound speakers, speaker-arrays, or headphones. The generation of audio effects frequently involves a virtual placement of sound sources at selected positions in three-dimensional space, including behind, above or below the listener.

3D audio processing may involve a spatial domain convolution of sound waves using head-related transfer functions. Specifically, sound waves can be transformed, (e.g., using head-related transfer function (HTRF) or HRTF filters and/or cross talk cancellation techniques) to mimic natural sounds waves which emanate from a point in 3D space. The listener can thus perceive different sounds as coming from different 3D locations, even though the sounds may be produced by just two speakers.

HRTFs and binaural room impulse responses (BRIRs) are both important for generating immersive 3D audio signals through headphones. The immersive 3D audio signals provide spatial audio cues on which humans rely to localize sound in space: interaural level differences (ILD), interaural time differences (ITD) and spectral cues. However, HRTFs or BRIRs depend highly on individual anatomies, and the measurement of HRTFs or BRIRs in high resolution is time-consuming. Usually, non-individual HRTFs or synthesized BRIRs are applied for the binaural renderer instead.

Studies have shown that simulated directional sounds that are generated using non-individual HRTFs suffer from front-back confusion, which is a problem in static binaural rendering due to ambiguous interaural cues. In addition, the externalization of a simulated sound source may be reduced, especially for the virtual sound source in the median plane. The localization and externalization can be improved by the individual measurement of HRTFs/BRIRs, individualized HRTFs/BRIRs, and dynamic rendering that incorporates movements of the source or the listener by using head tracking devices. However, in many commercial applications, binaural rendering can neither use individual HRIRs nor high-quality head tracking devices.

SUMMARY OF THE INVENTION

The main technical field of the present disclosure is binaural audio reproduction over headphones. It is an object of the disclosure to improve the localization and externalization of mono or stereo signals in the median plane. This improves externalization and localization of virtual sound sources presented over headphones.

The foregoing and other objects are achieved by the subject matter of the independent claims. Further implementation forms are apparent from the dependent claims, the description and the figures.

A first aspect of the disclosure provides a method for processing a stereo signal, the method comprising: obtaining a center channel signal by up-mixing the stereo signal; generating a filtered center channel signal by applying one or more peak filters and one or more notch filters to the center channel signal; and generating a binaural signal based on the filtered center channel signal.

In one embodiment, the method further comprises obtaining the stereo signal.

The method for processing a stereo signal according to the first aspect can result in good localization and externalization of the stereo signal in the median plane.

Stereophonic sound or, more commonly, stereo, is a method of sound reproduction that creates an illusion of multi-directional audible perspective. This is usually achieved by using two or more independent audio channels through a configuration of two or more loudspeakers (or stereo headphones) in such a way as to create the impression of sound heard from various directions, as in natural hearing.

A stereo signal may contain synchronized directional information from the left and right aural fields. Normally a stereo signal comprises at least two channels, one for the left field and one for the right field.

In an example, a stereo signal may be obtained by a receiver. For example, the receiver may obtain the stereo signal from another device or another system via a wired or wireless communication channel.

In another example, a stereo signal may be obtained using a processor and at least two microphones. The at least two microphones are used to record information obtained from a sound source, and the processor is used to process information recorded by the microphones, to obtain the stereo signal.

Up-mixing, in its most general sense, is the opposite of down-mixing. This means that up-mixing is a process that can take some number of audio channels and turn them into a greater number of audio channels. For example, up-mixing may transform 2-channels into 5.1 channels. Up-mixing is commonly used to better integrate legacy two-channel mono, stereo, or surround encoded content into 5.1 channel programs. Chosen properly, up-mixing further speeds the transition to 5.1 by helping out legacy content, and by assisting in the creation of new 5.1 channel material.

In an example, an audio signal processing arrangement includes a first filter for splitting off signal components from the left channel signal at least within one frequency band. Signal components are split off from the right channel signal by a second filter. The output signals of the filters are compared with the right channel signal and the left channel signal, respectively. The filter parameters of the filters are adjusted to values at which there is maximum correlation between the compared signals according to a given criterion. The center channel signal is derived in dependence on the filter adjustment. This can be effected by combining the output signals of the filters. In this manner, a center channel signal is obtained formed by the correlating left and right channel signal components, so that the stereo image is hardly disturbed by the addition of the center channel signal, whereas the perceived position of the virtual sources in the stereo image becomes less dependent on the listener's position with respect to the left and right loudspeakers.

In one embodiment form of the first aspect, the method further comprises: obtaining a side channel signal by up-mixing the stereo signal; processing the side channel signal according to a first head related transfer function, to obtain a processed side channel signal; processing the filtered center channel signal according to a second head related transfer function, to obtain a processed center channel signal; and wherein the generating a binaural signal based on the filtered center channel signal comprises: generating the binaural signal based on the processed side channel signal and the processed center channel signal.

In an example, up-mixing the stereo signal to obtain the side channel signal and up-mixing the stereo signal to obtain the center channel signal are performed in one up-mixing process.

In an example, the head related transfer function, HRTF, which is used to process the side channel signal and the HRTF which is used to process the center channel signal are the same HRTF.

In another example, the HRTF which is used to process the side channel signal and the HRTF which is used to process the center channel signal are different.

In one embodiment of the first aspect, the method further comprises: obtaining a left channel signal and a right channel signal by up-mixing the stereo signal; processing the left channel signal and the right channel signal according to two pairs of head related transfer functions, to obtain a processed left channel signal and a processed right channel signal; processing the filtered center channel signal according to a pair of head related transfer functions, to obtain a processed center channel signal; and wherein the generating a binaural signal based on the filtered center channel signal comprises: generating a left signal of the binaural signal based on the processed left channel signal and the processed center channel signal, generating a right signal of the binaural signal based on the processed right channel signal and the processed center channel signal.

In an example, up-mixing the stereo signal to obtain the left channel signal, the right channel signal and up-mixing the stereo signal to obtain the center channel signal are performed in one up-mixing process.

In another example, the HRTF which is used to process the left channel signal, the right channel signal and the HRTF which is used to process the center channel signal are different.

In one embodiment of the first aspect, the method further comprises: filtering the side channel signal and the center channel signal, using one or more decorrelation filters, to obtain a decorrelated side signal and a decorrelated center signal; and obtaining a reflection signal based on the decorrelated side signal and the decorrelated center signal.

In an example, one decorrelation filter is used to filter the side channel signal and the center channel signal.

In another example, the decorrelation filter which is used to filter the side channel signal and the decorrelation filter which is used to filter the center channel signal are identical.

In another example, the decorrelation filter which is used to filter the side channel signal and the decorrelation filter which is used to filter the center channel signal are different filters.

In one embodiment of the first aspect, the method further comprises: filtering the left channel signal, the right channel signal and the center channel signal, using one or more decorrelation filters, to obtain a decorrelated left signal, a decorrelated right signal and a decorrelated center signal; and obtaining a reflection signal based on the decorrelated left signal, the decorrelated right signal and the decorrelated center signal.

In an example, one decorrelation filter is used to filter the left channel signal, the right channel signal and the center channel signal.

In another example, the decorrelation filter which is used to filter left channel signal and the right channel signal and the decorrelation filter which is used to filter the center channel signal are identical.

In another example, the decorrelation filter which is used to filter left channel signal, the right channel signal and the decorrelation filter which is used to filter the center channel signal are different filters.

In an example, the decorrelation filter which is used to filter left channel signal and the decorrelation filter which is used to filter the right channel signal are same.

In an example, the decorrelation filter which is used to filter left channel signal and the decorrelation filter which is used to filter the right channel signal are different.

In one embodiment of the first aspect, the method further comprises: obtaining an initial audio signal; and decomposing the initial audio signal, using one or any combination of the following methods: Ambient Phase Estimation, Principal Component Analysis or Least Squares Analysis, to obtain the stereo signal.

In one embodiment of the first aspect, the method further comprises: obtaining an initial audio signal; decomposing the initial audio signal, using one or any combination of the following methods: Ambient Phase Estimation, Principal Component Analysis or Least Squares Analysis, to obtain the stereo signal and an ambient signal; obtaining a left channel signal and a right channel signal by up-mixing the stereo signal; adding the ambient signal with the left channel signal, to obtain a left sum signal; adding the ambient signal with the right channel signal, to obtain a right sum signal; processing the left sum signal and the right sum signal according to two pairs of head related transfer functions, to obtain a processed left channel signal and a processed right channel signal; processing the filtered center channel signal according to a pair of head related transfer functions, to obtain a processed center channel signal; and wherein the generating a binaural signal based on the filtered center channel signal comprises: generating a left signal of the binaural signal based on the processed left channel signal and the processed center channel signal, generating a right signal of the binaural signal based on the processed right channel signal and the processed center channel signal.

In an example, up-mixing the stereo signal to obtain the left channel signal and the right channel signal and up-mixing the stereo signal to obtain the center channel signal is performed in one up-mixing process.

In another example, the HRTF which is used to process the left channel signal and the right channel signal and the HRTF which is used to process the center channel signal are different.

In one embodiment form of the first aspect, the method further comprises: filtering the left channel signal, the right channel signal and the center channel signal, using one or more decorrelation filters, to obtain a decorrelated left signal, a decorrelated right signal and a decorrelated center signal; and obtaining a reflection signal based on the decorrelated left signal, the decorrelated right signal and the decorrelated center signal.

In an example, one decorrelation filter is used to filter the left channel signal, the right channel signal and the center channel signal.

In another example, the decorrelation filter which is used to filter the left channel signal and the right channel signal and the decorrelation filter which is used to filter the center channel signal are identical.

In another example, the decorrelation filter which is used to filter the left channel signal and the right channel signal and the decorrelation filter which is used to filter the center channel signal are different filters.

In an example, the decorrelation filter which is used to filter left channel signal and the decorrelation filter which is used to filter the right channel signal are identical.

In an example, the decorrelation filter which is used to filter left channel signal and the decorrelation filter which is used to filter the right channel signal are different filters.

In one embodiment of the first aspect, the method further comprises: obtaining a left channel signal and a right channel signal by up-mixing the stereo signal; convolving the stereo signal with a local reverberation to obtain a convolved stereo signal; adding the convolved stereo signal with the left channel signal, to obtain a left sum signal; adding the convolved stereo signal with the right channel signal, to obtain a right sum signal; processing the left sum signal and the right sum signal according to two pairs of head related transfer functions, to obtain a processed left channel signal and a processed right channel signal; processing the filtered center channel signal according to a pair of head related transfer functions, to obtain a processed center channel signal; and wherein the generating a binaural signal based on the filtered center channel signal comprises: generating a left signal of the binaural signal based on the processed left channel signal and the processed center channel signal, generating a right signal of the binaural signal based on the processed right channel signal and the processed center channel signal.

In an example, up-mixing the stereo signal to obtain the left channel signal, the right channel signal and up-mixing the stereo signal to obtain the center channel signal are performed in one up-mixing process.

In another example, the HRTF which is used to process the left channel signal, the right channel signal and the HRTF which is used to process the center channel signal are different.

In one embodiment of the first aspect, the method further comprises: filtering the left channel signal, the right channel signal and the center channel signal, using one or more decorrelation filters, to obtain a decorrelated left signal, a decorrelated right signal and a decorrelated center signal; and obtaining a reflection signal based on the decorrelated left signal, the decorrelated right signal and the decorrelated center signal.

In an example, one decorrelation filter is used to filter the left channel signal, the right channel signal and the center channel signal.

In another example, the decorrelation filter which is used to filter left channel signal, the right channel signal and the decorrelation filter which is used to filter the center channel signal are same.

In another example, the decorrelation filter which is used to filter left channel signal, the right channel signal and the decorrelation filter which is used to filter the center channel signal are different filters.

In an example, the decorrelation filter which is used to filter left channel signal and the decorrelation filter which is used to filter the right channel signal are same.

In an example, the decorrelation filter which is used to filter left channel signal and the decorrelation filter which is used to filter the right channel signal are different.

In one embodiment of the first aspect, the method further comprises: obtaining a left channel signal and a right channel signal by up-mixing the stereo signal; convolving the stereo signal with a local reverberation to obtain a convolved stereo signal; processing the left channel signal and the right channel signal according to two pairs of head related transfer functions, to obtain a processed left channel signal and a processed right channel signal; processing the filtered center channel signal according to a pair of head related transfer functions to obtain a processed center channel signal; wherein the generating a binaural signal based on the filtered center channel signal comprises: generating a left signal of the binaural signal based on the processed left channel signal, the convolved stereo signal and the processed center channel signal, generating a right signal of the binaural signal based on the processed right channel signal, the convolved stereo signal and the processed center channel signal.

In an example, up-mixing the stereo signal to obtain the left channel signal and the right channel signal and up-mixing the stereo signal to obtain the center channel signal are performed in one up-mixing process.

In another example, the HRTF which is used to process the left channel signal and the right channel signal and the HRTF which is used to process the center channel signal are different functions.

In one embodiment of the first aspect, the method further comprises: filtering the left channel signal, the right channel signal and the center channel signal, using one or more decorrelation filters, to obtain a decorrelated left signal, a decorrelated right signal and a decorrelated center signal; and obtaining a reflection signal based on the decorrelated left signal, the decorrelated right signal and the decorrelated center signal.

In an example, one decorrelation filter is used to filter the left channel signal, the right channel signal and the center channel signal.

In another example, the decorrelation filter which is used to filter left channel signal and the right channel signal and the decorrelation filter which is used to filter the center channel signal are identical.

In another example, the decorrelation filter which is used to filter left channel signal, the right channel signal and the decorrelation filter which is used to filter the center channel signal are different filters.

In an example, the decorrelation filter which is used to filter left channel signal and the decorrelation filter which is used to filter the right channel signal are identical.

In an example, the decorrelation filter which is used to filter left channel signal and the decorrelation filter which is used to filter the right channel signal are different.

In one embodiment form of the first aspect, the one or more peak filters comprises a first peak filterer centered at 4 kHz and having a ⅓-octave bandwidth, and a second peak filter centered at a frequency above 13 kHz and having a ¼-octave bandwidth; and wherein the one or more notch filters comprises: a notch filter centered at a frequency between 4 kHz and 8 kHz and having a 1-octave bandwidth.

In an example, the typical center frequency for the notch filter is 7 kHz, and the typical center frequency for the second peak filter is 13 kHz.

In one embodiment form of the first aspect, the one or more peak filters comprises a first peak filter centered at 1 kHz and having a ⅓-octave bandwidth, and a second peak filter centered at a frequency between 10 kHz and 12 kHz and having a ¼-octave bandwidth; and wherein the one or more notch filters comprises: a first notch filter centered at 9 kHz and having a ¼-octave bandwidth, a second notch filter centered at 16 kHz and having a ¼-octave bandwidth.

In an example, the typical center frequency for the second peak filter is 11 kHz.

A second aspect of the disclosure provides an apparatus for processing a stereo signal, the apparatus comprises processing circuitry configured to, obtain a center channel signal by up-mixing the stereo signal;

obtain a filtered center channel signal by applying one or more peak filters and one or more notch filters to the center channel signal; and generating a binaural signal based on the filtered center channel signal.

The processing circuitry may comprise hardware and software. The hardware may comprise analog or digital circuitry, or both analog and digital circuitry. In one embodiment, the processing circuitry comprises one or more processors and a non-volatile memory connected to the one or more processors. The non-volatile memory may carry executable program code which, when executed by the one or more processors, causes the apparatus to perform the operations or methods described herein.

The filters described in this disclosure may be implemented in hardware or in software or in a combination of hardware and software.

In one embodiment of the second aspect, the processing circuitry is further configured to obtain a side channel signal by up-mixing the stereo signal;

process the side channel signal according to a first head related transfer function, to obtain a processed side channel signal; and process the filtered center channel signal according to a second head related transfer function, to obtain a processed center channel signal;

wherein the binaural signal is generated based on the processed side channel signal and the processed center channel signal.

In one embodiment of the second aspect, the processing circuitry is further configured to obtain a left channel signal and a right channel signal by up-mixing the stereo signal;

process the left channel signal and the right channel signal according to two pairs of head related transfer functions, to obtain a processed left channel signal and a processed right channel signal; and process the filtered center channel signal according to a pair of head related transfer functions, to obtain a processed center channel signal; and wherein a left signal of the binaural signal is generated based on the processed left channel signal and the processed center channel signal, a right signal of the binaural signal is generated based on the processed right channel signal and the processed center channel signal.

In one embodiment of the second aspect, the processing circuitry is further configured to:

filter the side channel signal and the center channel signal, to obtain a decorrelated side signal and a decorrelated center signal; and obtain a reflection signal based on the decorrelated side signal and the decorrelated center signal.

In one embodiment of the second aspect, processing circuitry is further configured to, filter the left channel signal, the right channel signal and the center channel signal, to obtain a decorrelated left signal, a decorrelated right signal and a decorrelated center signal; and obtain a reflection signal based on the decorrelated left signal, the decorrelated right signal and the decorrelated center signal.

In one embodiment of the second aspect, wherein the processing circuitry is configured to obtain an initial audio signal, and decompose the initial audio signal, using one or any combination of the following methods: Ambient Phase Estimation, Principal Component Analysis or Least Squares Analysis, to obtain the stereo signal.

In one embodiment of the second aspect, wherein the processing circuitry is configured to obtain an initial audio signal, decompose the initial audio signal, using one or any combination of the following methods: Ambient Phase Estimation, Principal Component Analysis or Least Squares Analysis, to obtain the stereo signal and an ambient signal;

obtain a left channel signal and a right channel signal by up-mixing the stereo signal;

add the ambient signal to the left channel signal, to obtain a left sum signal, add the ambient signal to the right channel signal, to obtain a right sum signal;

process the left sum signal and the right sum signal according to two pairs of head related transfer functions, to obtain a processed left channel signal and a processed right channel signal, and process the filtered center channel signal according to a pair of head related transfer functions to obtain a processed center channel signal;

generate a left signal of the binaural signal based on the processed left channel signal and the processed center channel signal, and generate a right signal of the binaural signal based on the processed right channel signal and the processed center channel signal.

In one embodiment of the second aspect, the processing circuitry is further configured to:

filter the left channel signal, the right channel signal and the center channel signal, to obtain a decorrelated left signal, a decorrelated right signal and a decorrelated center signal; and obtain a reflection signal based on the decorrelated left signal, the decorrelated right signal and the decorrelated center signal.

In one embodiment of the second aspect, the processing circuitry is further configured to obtain a left channel signal and a right channel signal by up-mixing the stereo signal;

convolve the stereo signal with a local reverberation to obtain a convolved stereo signal;

add the convolved stereo signal with the left channel signal, to obtain a left sum signal, add the convolved stereo signal with the right channel signal, to obtain a right sum signal;

process the left sum signal and the right sum signal according to two pairs of head related transfer functions, to obtain a processed left channel signal and a processed right channel signal; and process the filtered center channel signal according to a pair of head related transfer functions, to obtain a processed center channel signal;

generate a left signal of the binaural signal based on the processed left channel signal and the processed center channel signal, generate a right signal of the binaural signal based on the processed right channel signal and the processed center channel signal.

In one embodiment of the second aspect, the processing circuitry is further configured to, filter the left channel signal, the right channel signal and the center channel signal, to obtain a decorrelated left signal, a decorrelated right signal and a decorrelated center signal; and obtain a reflection signal based on the decorrelated left signal, the decorrelated right signal and the decorrelated center signal.

In one embodiment of the second aspect, the processing circuitry is further configured to obtain a left channel signal and a right channel signal by up-mixing the stereo signal;

convolve the stereo signal with a local reverberation to obtain a convolved stereo signal;

process the left channel signal and the right channel signal according to two pairs of head related transfer functions, to obtain a processed left channel signal and a processed right channel signal; and process the filtered center channel signal according to a pair of head related transfer functions, to obtain a processed center channel signal;

generate a left signal of the binaural signal based on the processed left channel signal, the convolved stereo signal and the processed center channel signal, generate a right signal of the binaural signal based on the processed right channel signal, the convolved stereo signal and the processed center channel signal.

In one embodiment of the second aspect, the processing circuitry is further configured to, filter the left channel signal, the right channel signal and the center channel signal, to obtain a decorrelated left signal, a decorrelated right signal and a decorrelated center signal; and obtain a reflection signal based on the decorrelated left signal, the decorrelated right signal and the decorrelated center signal.

In one embodiment of the second aspect, wherein the one or more peak filters comprise a first peak filterer centered at 4 kHz and having a ⅓-octave bandwidth, and a second peak filter centered at a frequency above 13 kHz and having a ¼-octave bandwidth; and wherein the one or more notch filters comprises:

a notch filter centered at a frequency between 4 kHz and 8 kHz with 1-octave bandwidth.

In one embodiment of the second aspect, wherein the one or more peak filters comprise a first peak filter centered at 1 kHz and having a ⅓-octave bandwidth, and a second peak filter centered at a frequency between 10 kHz and 12 kHz and having a ¼-octave bandwidth; and wherein the one or more notch filters comprise:

a first notch filter centered at 9 kHz and having a ¼-octave bandwidth, a second notch filter centered at 16 kHz and having a ¼-octave bandwidth.

A third aspect of the disclosure provides an apparatus for processing a stereo signal, the apparatus comprises: an up-mix unit configured to obtain a center channel signal by up-mixing the stereo signal; one or more peak filters and one or more notch filters configured to filter the center channel signal to obtain a filtered center channel signal; and a binaural signal generate unit configured to generate a binaural signal based on the filtered center channel signal.

In one embodiment, the apparatus comprises a stereo signal obtain unit configured to obtain the stereo signal.

In one embodiment of the third aspect, the up-mix unit is further configured to obtain a side channel signal by up-mixing the stereo signal; the apparatus further comprises a head related transfer function, HRTF, unit, the HRTF unit is configured to process the side channel signal according to a first head related transfer function, to obtain a processed side channel signal; the HRTF unit is further configured to process the filtered center channel signal according to a second head related transfer function, to obtain a processed center channel signal; and wherein the binaural signal generate unit is configured to generate the binaural signal based on the processed side channel signal and the processed center channel signal.

In one embodiment of the third aspect, the up-mix unit is further configured to obtain a left channel signal and a right channel signal by up-mixing the stereo signal; the apparatus further comprises a head related transfer function, HRTF, unit, the HRTF unit is configured to process the left channel signal and the right channel signal according to two pairs of head related transfer functions, to obtain a processed left channel signal and a processed right channel signal; the HRTF unit is further configured to process the filtered center channel signal according to a pair of head related transfer functions, to obtain a processed center channel signal; and wherein the binaural signal generate unit is configured to generate a left signal of the binaural signal based on the processed left channel signal and the processed center channel signal, the binaural signal generate unit is configured to generate a right signal of the binaural signal based on the processed right channel signal and the processed center channel signal.

In one embodiment of the third aspect, the apparatus further comprises: one or more decorrelation filters configured to filter the side channel signal and the center channel signal, to obtain a decorrelated side signal and a decorrelated center signal; and a reflection obtain unit configured to obtain a reflection signal based on the decorrelated side signal and the decorrelated center signal.

In one embodiment of the third aspect, the apparatus further comprises: one or more decorrelation filters configured to filter the left channel signal, the right channel signal and the center channel signal, to obtain a decorrelated left signal, a decorrelated right signal and a decorrelated center signal; and a reflection obtain unit configured to obtain a reflection signal based on the decorrelated left signal, the decorrelated right signal and the decorrelated center signal.

In one embodiment of the third aspect, the stereo signal obtain unit is configured to obtain an initial audio signal, and decompose the initial audio signal, using one or any combination of the following methods: Ambient Phase Estimation, Principal Component Analysis or least squares, to obtain the stereo signal.

In one embodiment of the third aspect, the stereo signal obtain unit is configured to obtain an initial audio signal, decompose the initial audio signal, using one or any combination of the following methods: Ambient Phase Estimation, Principal Component Analysis or Least Squares Analysis, to obtain the stereo signal and an ambient signal;

the up-mix unit is further configured to obtain a left channel signal and a right channel signal by up-mixing the stereo signal; the apparatus further comprises a head related transfer function, HRTF, unit, the HRTF unit is configured to add the ambient signal to the left channel signal, to obtain a left sum signal, add the ambient signal to the right channel signal, to obtain a right sum signal; the HRTF unit is further configured to process the left sum signal and the right sum signal according to two pairs of head related transfer functions, to obtain a processed left channel signal and a processed right channel signal, and the HRTF unit is further configured to process the filtered center channel signal according to a pair of head related transfer functions, to obtain a processed center channel signal; and wherein the binaural signal generate unit is configured to generate a left signal of the binaural signal based on the processed left channel signal and the processed center channel signal, generate a right signal of the binaural signal based on the processed right channel signal and the processed center channel signal.

In one embodiment of the third aspect, the apparatus further comprises: one or more decorrelation filters configured to filter the left channel signal, the right channel signal and the center channel signal, to obtain a decorrelated left signal, a decorrelated right signal and a decorrelated center signal; and a reflection obtain unit configured to obtain a reflection signal based on the decorrelated left signal, the decorrelated right signal and the decorrelated center signal.

In one embodiment of the third aspect, the up-mix unit is further configured to obtain a left channel signal and a right channel signal by up-mixing the stereo signal; the apparatus further comprises a convolve unit, the convolve unit is configured to convolve the stereo signal with a local reverberation to obtain a convolved stereo signal; the apparatus further comprises a head related transfer function, HRTF, unit, the HRTF unit is configured to add the convolved stereo signal with the left channel signal, to obtain a left sum signal, add the convolved stereo signal with the right channel signal, to obtain a right sum signal; the HRTF unit is further configured to process the left sum signal and the right sum signal according to two pairs of head related transfer functions, to obtain a processed left channel signal and a processed right channel signal, and the HRTF unit is further configured to process the filtered center channel signal according to a pair of head related transfer functions, to obtain a processed center channel signal; and wherein the binaural signal generate unit is configured to generate a left signal of the binaural signal based on the processed left channel signal and the processed center channel signal, generate a right signal of the binaural signal based on the processed right channel signal and the processed center channel signal.

In one embodiment of the third aspect, the apparatus further comprises: one or more decorrelation filters configured to filter the left channel signal, the right channel signal and the center channel signal, to obtain a decorrelated left signal, a decorrelated right signal and a decorrelated center signal; and a reflection obtain unit configured to obtain a reflection signal based on the decorrelated left signal, the decorrelated right signal and the decorrelated center signal.

In one embodiment of the third aspect, the up-mix unit is further configured to obtain a left channel signal and a right channel signal by up-mixing the stereo signal; the apparatus further comprises a convolve unit, the convolve unit is configured to convolve the stereo signal with a local reverberation to obtain a convolved stereo signal; the apparatus further comprises a head related transfer function, HRTF, unit, the HRTF unit is configured to process the left channel signal and the right channel signal according to two pairs of head related transfer functions, to obtain a processed left channel signal and a processed right channel signal; the HRTF unit is further configured to process the filtered center channel signal according to a pair of head related transfer functions, to obtain a processed center channel signal; and wherein the binaural signal generate unit is configured to generate a left signal of the binaural signal based on the processed left channel signal, the convolved stereo signal and the processed center channel signal, generate a right signal of the binaural signal based on the processed right channel signal, the convolved stereo signal and the processed center channel signal.

In one embodiment of the third aspect, the apparatus further comprises: one or more decorrelation filters configured to filter the left channel signal, the right channel signal and the center channel signal, to obtain a decorrelated left signal, a decorrelated right signal and a decorrelated center signal; and a reflection obtain unit configured to obtain a reflection signal based on the decorrelated left signal, the decorrelated right signal and the decorrelated center signal.

In one embodiment of the third aspect, the one or more peak filters comprise a first peak filter centered at 4 kHz and having a ⅓-octave bandwidth and a second peak filter centered at a frequency above 13 kHz and having a ¼-octave bandwidth; and the one or more notch filters comprises a notch filter centered at a frequency between 4 kHz and 8 kHz with 1-octave bandwidth.

In one embodiment of the third aspect, the one or more peak filters comprise a first peak filter centered at 1 kHz and having a ⅓-octave bandwidth, and a second peak filter centered at a frequency between 10 kHz and 12 kHz and having a ¼-octave bandwidth, and the one or more notch filters comprise a first notch filter centered at 9 kHz and having a ¼-octave bandwidth and a second notch filter centered at 16 kHz and having a ¼-octave bandwidth.

The method according to the first aspect of the disclosure can be performed by the apparatus according to the second aspect or the third aspect of the disclosure. Further features of the method according to the first aspect of the disclosure result directly from the functionality of the apparatus according to the second aspect or the third aspect of the disclosure and its different embodiment forms.

A fourth aspect of the disclosure relates to a computer-readable storage medium storing program code. The program code comprises instructions for carrying out the method of the first aspect or one of its embodiments.

The disclosure can be implemented in hardware and/or software.

BRIEF DESCRIPTION OF THE DRAWINGS

To illustrate the technical features of embodiments of the present disclosure more clearly, the accompanying drawings provided for describing the embodiments are introduced briefly in the following. The accompanying drawings in the following description are merely some embodiments of the present disclosure, but modifications on these embodiments are possible without departing from the scope of the present disclosure as defined in the claims.

Figure 1:
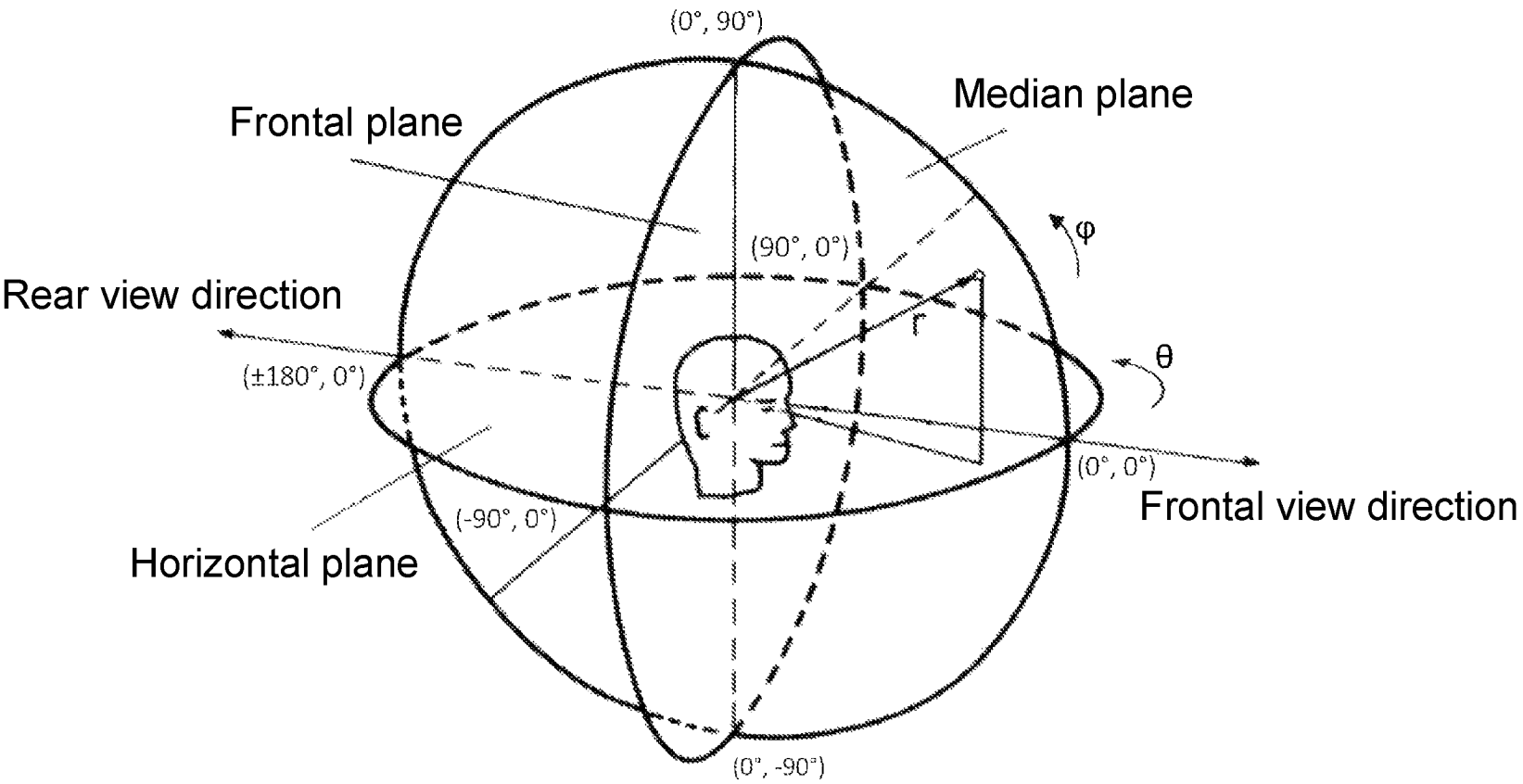
FIG. 1 shows an example about a sound space is divided into three planes, the horizontal plane, the median plane and the frontal plane.

In the figures, identical reference signs will be used for identical or functionally equivalent features.

DETAILED DESCRIPTION OF THE EMBODIMENTS

In the following description, reference is made to the accompanying drawings, which form part of the disclosure, and in which are shown, by way of illustration, specific aspects in which the disclosure may be placed. It will be appreciated that the disclosure may be placed in other aspects and that structural or logical changes may be made without departing from the scope of the disclosure. The following detailed description, therefore, is not to be taken in a limiting sense, as the scope of the disclosure is defined by the appended claims.

For instance, it will be appreciated that a disclosure in connection with a described method will generally also hold true for a corresponding device or system configured to perform the method and vice versa. For example, if a specific method step is described, a corresponding device may include a unit to perform the described method step, even if such unit is not explicitly described or illustrated in the figures.

Moreover, in the following detailed description as well as in the claims, embodiments with functional blocks or processing units are described, which are connected with each other or exchange signals. It will be appreciated that the disclosure also covers embodiments which include additional functional blocks or processing units, such as pre- or post-filtering and/or pre- or post-amplification units, that are arranged between the functional blocks or processing units of the embodiments described below.

Finally, it is understood that the features of the various exemplary aspects described herein may be combined with each other, unless specifically noted otherwise.

A channel is a pathway for passing on information, in this context sound information. Physically, it might, for example, be a tube you speak down, or a wire from a microphone to an earphone, or connections between electronic components inside an amplifier or a computer.

A track is a physical home for the contents of a channel when recorded on magnetic tape. There can be as many parallel tracks as technology allows, but for everyday purposes there are 1, 2 or 4. Two tracks can be used for two independent mono signals in one or both playing directions, or a stereo signal in one direction. Four tracks (such as a cassette recorder) are organized to work pairwise for a stereo signal in each direction; a mono signal is recorded on one track (same track as the left stereo channel) or on both simultaneously (depending on the tape recorder or on how the mono signal source is connected to the recorder).

A mono sound signal does not contain any directional information. In an example, there may be several loudspeakers along a railway platform and hundreds around an airport, but the signal remains mono. Directional information cannot be generated simply by sending a mono signal to two "stereo" channels. However, an illusion of direction can be conjured from a mono signal by panning it from channel to channel.

A stereo sound signal may contain synchronized directional information from the left and right aural fields. Consequently, it requires at least two channels, one for the left field and one for the right field. The left channel is fed by a mono microphone pointing at the left field and the right channel by a second mono microphone pointing at the right field (you will also find stereo microphones that have the two directional mono microphones built into one piece). In an example, Quadraphonic stereo uses four channels, surround stereo has at least additional channels for anterior and posterior directions apart from left and right. Public and home cinema stereo systems can have even more channels, dividing the sound fields into narrower sectors.

In an example, an audio signal processing arrangement includes a first filter for splitting off signal components from the left channel signal at least within one frequency band. Signal components are split off from the right channel signal by a second filter. The output signals of the filters are compared with the right channel signal and the left channel signal, respectively. The filter parameters of the filters are adjusted to values at which there is maximum correlation between the compared signals according to a given criterion. The center channel signal is derived in dependence on the filter adjustment. This can be effected by combining the output signals of the filters. In this manner, a center channel signal is obtained formed by the correlating left and right channel signal components, so that the stereo image is hardly disturbed by the addition of the center channel signal, whereas the perceived position of the virtual sources in the stereo image becomes less dependent on the listener's position with respect to the left and right loudspeakers.

It is important that the externalization and the localization accuracy can be enhanced by applying non-individual HRTFs/BRIRs for the binaural rendering system.

In an example, a sound space is divided into three specific planes: the horizontal plane, the median plane and the frontal plane, as shown in FIG. 1. The three planes are perpendicular to one another and intersect at the origin. This clockwise spherical coordinate system is also called head related coordinate system in some documents, in which the angle between the directional vector of the sound source and the horizontal plane is denoted by elevation angle $\varphi$ with $-90° \leq \varphi \leq 90°$ and the angle between the horizontal projection of directional vector and the front is denoted by azimuth angle $\theta$ with $-180° < \theta \leq 180°$. A sound source directly in front of the listening subject corresponds to 0° in Azimuth and Elevation.

There is another example to design some adjustment filters based on peak and notch filters to improve the sound localization in the median plane.

TABLE 1

| Filter Type | Center Frequency | Band Width |
|---|---|---|
| | "Frontness" | |
| Peak | 4 kHz | 1/4 octave |
| Notch | 7.5 kHz | 1 octave |
| Peak | 14 kHz | 1/4 octave |
| | "Aboveness" | |
| Peak | 4 kHz | 1/4 octave |
| Peak | 8 kHz | 1/4 octave |
| | "Behindness" | |
| Peak | 4 kHz | 1/4 octave |
| Notch | 9 kHz | 1/4 octave |
| Peak | 11 kHz | 1/4 octave |
| Notch | 16 kHz | 1/4 octave |

The positions of the peak and notch filters for frontal, above and rear sound sources are listed in Table 1. In this method, the design of peak and notch filters is based on the characteristic of HRTF itself and a little psychoacoustic experiments. Since some information of peaks and notches is already included in the HRTF, it is somehow like enlarge the spectral difference, which may introduce coloration problem. In addition, identical gain factors applied for different azimuth angles may introduce localization problem.

In another example, the input signals are divided into 5 sub-bands by a bandpass filter bank and configured to emphasize or deemphasize each band for maximum localization ability. However, this method requires fine-tuning the gains of all band-pass filters by the user which is not very practical. In addition, the bandwidth of the sub-bands is fixed, and there is no discussion about the choice of the bandwidth. Some psychoacoustic experiments indicated that the bandwidths of filters also play an important role in enhancement of sound source localization. Some methods tried to minimize the cone-of-confusion by spectral adjustments which simulate HRTF characteristics of subjects showing good performance in front-back localization (with large protrusion angle). One method is similar to emphasizing or deemphasizing the magnitude in some special frequencies. However, this method requires individual HRTF measurements, which is not practical. These methods may increase the peak or notch components of HRTF to enlarge the spectral difference of confusion direction. However, in these methods, larger spectral differences between rendered front and rear sound sources cannot guarantee better localization when only frontal or rear sound sources are rendered. These methods are only suitable on the horizontal plane. Also, loss of direction and bad sound quality may result.

Figure 2:
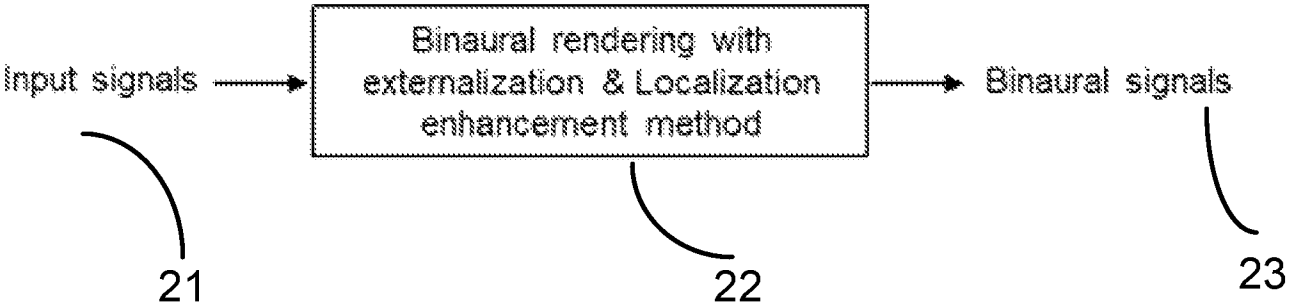
FIG. 2 shows a schematic diagram of a method of binaural rendering with externalization and localization enhancement method according to an embodiment.

In another example, a method is disclosed to enhance externalization of a mono audio signal. As shown in FIG. 2, a mono audio signal is first filtered by a pair of modeled HRTF, then the filtered signals are decorrelated to enhance the spaciousness of sound images. The image source method based reverberator is designed to simulate the reverberation. Finally, a pair of notch filters is designed based on averaged HRTFs at 0° from the center for image processing and integrated computing (CIPIC) database to enhance the sound localization. In this example, the decorrelator is applied to the direct part and thus the localization accuracy of a frontal sound source may be reduced (there is no separation between direct and early reflection in the processing). The notch filter is based on measured HRTFs and applied to binaural rendered signals. Any mismatch between the user's HRTF and the model used will cause bad quality.

In the case of a pair of virtual stereo signals (e.g., located at −30° and 30°), the generated phantom signal (0°) is difficult to be perceived as externalized. Some methods involving up-mixing stereo signals to center (i.e. center channel signal) and side signals are proposed. In these methods, the center and two side signals can be considered as three virtual sound sources. A method is disclosed to up-mix stereo signals to virtual surround sound to enhance the spaciousness of the rendered signals. However, the externalization and localization of rendered sound sources in the median plane are not enhanced. It is an object of one embodiment of the present disclosure to further enhance externalization based on an upmixed signal.

Figure 19:
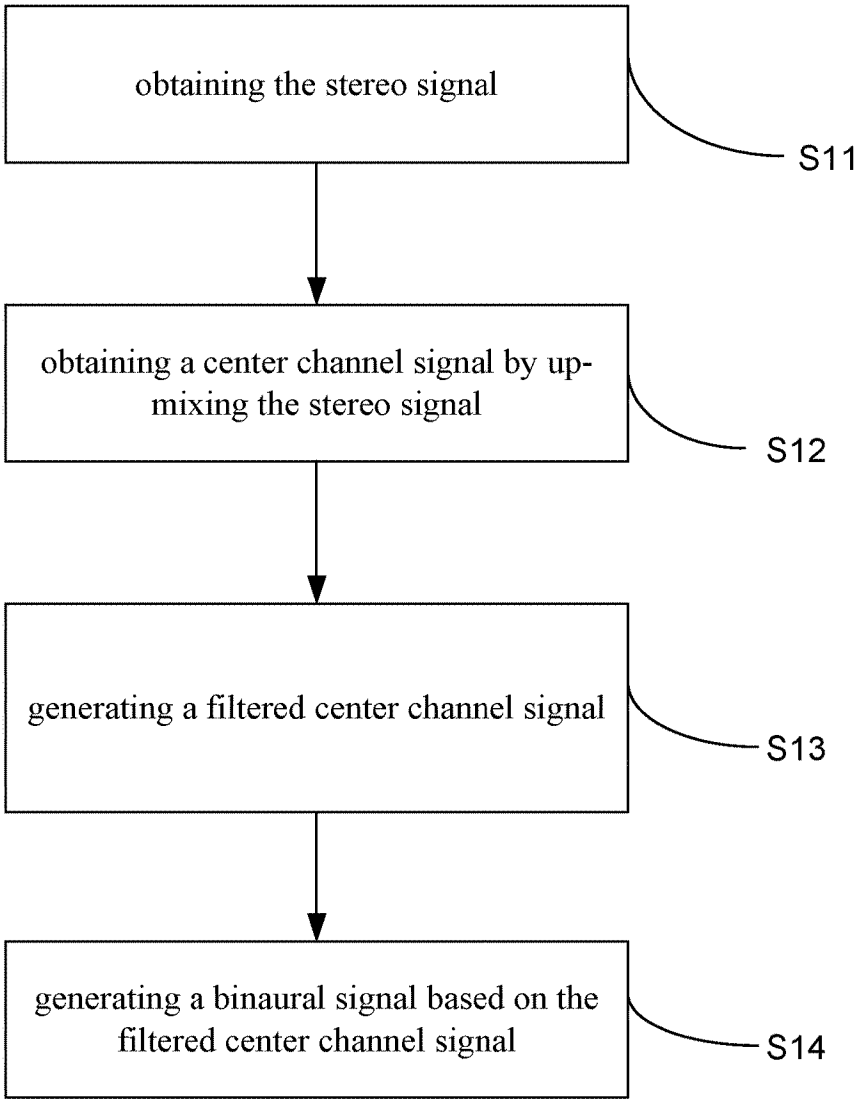
FIG. 19 shows a schematic diagram of a method for processing a stereo signal according to an embodiment.

FIG. 19 shows a schematic diagram of a method for processing a stereo signal according to an embodiment. The method comprises:

S11: obtaining the stereo signal.

Stereophonic sound or, more commonly, stereo, is a method of sound reproduction that creates an illusion of multi-directional audible perspective. This is usually achieved by using two or more independent audio channels through a configuration of two or more loudspeakers (or stereo headphones) in such a way as to create the impression of sound heard from various directions, as in natural hearing.

A stereo signal may contain synchronized directional information from the left and right aural fields. Normally a stereo signal comprises at least two channels, one for the left field and one for the right field.

In an example, a stereo signal may be obtained by a receiver. For example, the receiver may obtain the stereo signal from another device or another system over a wired or wireless communication channel.

In another example, a stereo signal may be obtained according to a processor and at least two microphones. The at least two microphones are used to record information obtained from a sound source, and the processor is used to process information recorded by the microphones, to obtain the stereo signal.

In one embodiment, the obtaining the stereo signal comprises: obtaining an initial audio signal; and decomposing the initial audio signal, using one or any combination of the following methods: Ambient Phase Estimation, Principal Component Analysis or Least Squares Analysis, to obtain the stereo signal.

S12: obtaining a center channel signal by up-mixing the stereo signal.

Up-mixing, in its most general sense, is the opposite of down-mixing. This means that up-mixing is a process that transforms a set of audio channels into a new set of audio channels which comprises more audio channels than the initial set. For example, up-mixing may transform 2 channels into 5.1 channels. Up-mixing is commonly used to better integrate legacy two-channel mono, stereo, or surround encoded content into 5.1 channel programs. Chosen properly, up-mixing further speeds the transition to 5.1 by helping out legacy content, and by assisting in the creation of new 5.1 channel material.

In an example, a strategy for up-mixing a stereo signal into a multi-channel signal is based on predicting or guessing the way in which the sound engineer would have proceeded if she or he were doing a multi-channel mix. For example, in the direct/ambient approach the ambience signals recorded at the back of the venue in the live recording could have been sent to the rear channels of the surround mix to achieve the immersion of the listener in the sound field. Or in the case of studio mix, a multi-channel reverberation unit could have been used to create this effect by assigning different reverberation levels to the front and rear channels. Also, the availability of a center channel could have helped the engineer to create a more stable frontal image for off-the-axis listening by panning the instruments among three channels instead of two. A series of techniques are disclosed for extracting and manipulating information in the stereo signals. Each signal in the stereo recording is analyzed by computing its Short-Time Fourier Transform (STFT) to obtain its time-frequency representation, and then comparing the two signals in this new domain using a variety of metrics. One or many mapping or transformation functions are then derived based on the particular metric and applied to modify the STFT's of the input signals.

In another example, in a stereo mix it is common that one featured vocalist or soloist is panned to the center. The intention of the sound engineer doing the mix is to create the auditory impression that the soloist is in the center of the stage. However, in a two-loudspeaker reproduction set up, the listener needs to be positioned exactly between the loudspeakers (e.g., the sweet spot) to perceive the intended auditory image. If the listener moves closer to one of the loudspeakers, the perception is destroyed by the precedence effect, and the image collapses towards the direction of the loudspeaker. For this reason (among others), a center channel containing the dialogue is used in movie theatres, so that the audience sitting towards either side of the room can still associate the dialogue with the image on the screen. In fact, most of the popular home multi-channel formats like 5.1 Surround now include a center channel to deal with this problem. If the sound engineer had had the option to use a center channel, he or she would have probably panned (or sent) the soloist or dialogue exclusively to this channel. Moreover, not only the center-panned signal collapses for off-axis listeners. Sources panned primarily toward on side (far from the listener) might appear to be panned toward the opposite side (closer to the listener). The sound engineer could have also avoided this by panning among the three channels, for example by panning between center and left-front channels all the sources with spatial locations on the left hemisphere, and panning between center and right-front channels all sources with locations toward the right.

S13: generating a filtered center channel signal.

A filtered center channel signal is generated by applying one or more peak filters and one or more notch filters to the center channel signal.

In one embodiment, the one or more peak filters and one or more notch filters, comprise: a notch filter centered at a frequency between 4 kHz and 8 kHz and having a 1-octave bandwidth, a first peak filter centered at 4 kHz and having a ⅓-octave bandwidth, and a second peak filter centered at a frequency above 13 kHz and having a ¼-octave bandwidth.

In an example, the typical center frequency for the notch filter is 7 kHz, and the typical center frequency for the second peak filter is 13 kHz.

In one embodiment, the one or more peak filters and one or more notch filters, comprises: a first notch filter centered at 9 kHz and having a ¼-octave bandwidth, a second notch filter centered at 16 kHz and having a ¼-octave bandwidth, a first peak filter centered at 1 kHz and having a ⅓-octave bandwidth, and a second peak filter centered at a frequency between 10 kHz and 12 kHz and having a ¼-octave bandwidth.

In an example, the typical center frequency for the second peak filter is 11 kHz.

In an example, the filtering process may be performed according to the following formula:

Input signal: s(t)

Peak and notch filter: p(t).

This formula is a convolution in time domain, t denotes for time, $\tau$ is a variable which should is integrated from $-\infty$ to $\infty$. $d\tau$ stands for an infinitesimal piece of the variable $\tau$.

$$s'(t)=s(t)*p(t)=\int_{-\infty}^{\infty}p(t-\tau)s(\tau)d\tau,$$

* denotes convolution.

The input signal s(t) may be a mono signal or a center channel signal.

S14: generating a binaural signal based on the filtered center channel signal.

The method for processing a stereo signal improve the localization and externalization of stereo signal in the median plane.

In one embodiment, the method further comprises: obtaining a side channel signal by up-mixing the stereo signal; processing the side channel signal, according to a first head related transfer function, to obtain a processed side channel signal; processing the filtered center channel signal, according to a second head related transfer function, to obtain a processed center channel signal; and wherein the generating a binaural signal based on the filtered center channel signal comprises: generating the binaural signal based on the processed side channel signal and the processed center channel signal.

In one embodiment, a head related transfer function convolution is performed according to the formula:

$$d_i(t)=s(t)*\mathrm{hrir}_i(t)=\int_{-\infty}^{\infty}\mathrm{hrir}_i(t-\tau)s(\tau)d\tau, i\in\{\mathrm{left, right}\}\mathrm{hrir}_i(t)=\mathrm{IFFT}\{\mathrm{HRTF}_i(f)\}$$

s(t) denotes a signal which is inputted to this process, * denotes convolution, s(t) is input signal, $d_i(t)$ is the output signal of this process.

t denotes for time, $\tau$ is a variable, which should be integrated from $-\infty$ to $\infty$. $d\tau$ stands for the smallest piece of the variable $\tau$. IFFT is the backwards Fourier transformation.

$i\in\{\mathrm{left,right}\}$ means, the symbol "i" can stand for the left or the right. For example, $\mathrm{hrir}_i(t)$ means the $\mathrm{hrir}_{left}(t)$ or $\mathrm{hrir}_{right}(t)$.

In one embodiment, the method further comprises: obtaining a left channel signal and a right channel signal by up-mixing the stereo signal; processing the left channel signal and the right channel signal according to two pairs of head related transfer functions to obtain a processed left channel signal and a processed right channel signal; processing the filtered center channel signal according to a pair of head related transfer functions to obtain a processed center channel signal; and wherein the generating a binaural signal based on the filtered center channel signal comprises: generating a left signal of the binaural signal based on the processed left channel signal and the processed center channel signal, generating a right signal of the binaural signal based on the processed right channel signal and the processed center channel signal.

In one embodiment, the method further comprises: filtering the side channel signal and the center channel signal, using one or more decorrelation filters, to obtain a decorrelated side signal and a decorrelated center signal; and obtaining a reflection signal based on the decorrelated side signal and the decorrelated center signal.

In an example, a decorrelated signal is generated in accordance with the following formula (which defines an example of a decorrelation filter):

$$s(f_i, t) = IFFT\{FFT\{s(t)\} \times C(f_i, f)\}\}, \text{ with } i = 1, 2, 3, \ldots, 24$$

$$s''_{left}(t) = \sum_{i=1}^{24} s(f_i, t)$$

$$s''_{right}(t) = \sum_{i=1}^{24} s(f_i, t - \tau_i)$$

wherein $\tau_i$ is randomized, $f_i$ is a center frequency, and the coefficients $C(f_i, f)$ represent a critical band filter bank. FFT means the Fourier transformation, transforming the signal from time domain to frequency domain. IFFT is the backwards Fourier transformation, transforming the signal from frequency domain to time domain. f means the frequency. $f_i$ is the center frequency. t is the time. $\Sigma_{i=1}^{24} s(f_i, t)$ means the summation of $s(f_i,t)$, i.e., $s(f_1, t)+s(f_2, t)+s(f_3, t)+s(f_4, t) \ldots s(f_{24}, t)$.

In audiology and psychoacoustics the concept of critical bands describes the frequency bandwidth of the "auditory filter" created by the cochlea, the sense organ of hearing within the inner ear.

In one embodiment, the method further comprises: filtering the left channel signal, the right channel signal and the center channel signal, using one or more decorrelation filters, to obtain a decorrelated left signal, a decorrelated right signal and a decorrelated center signal; and obtaining a reflection signal based on the decorrelated left signal, the decorrelated right signal and the decorrelated center signal.

In one embodiment, the location of $i^{th}$ order image-sources along the x-, y- and z-coordinate $\{x_i, y_i, z_i\}$ can be expressed as:

$$\begin{pmatrix} x_i \\ y_i \\ z_i \end{pmatrix} = \begin{pmatrix} (-1)^i x_s + \left[i + \frac{1-(-1)^i}{2}\right] x_r \\ (-1)^i y_s + \left[i + \frac{1-(-1)^i}{2}\right] y_r \\ (-1)^i z_s + \left[i + \frac{1-(-1)^i}{2}\right] z_r \end{pmatrix}$$

where $\{x_s, y_s, z_5\}$ and $\{x_r, y_r, z_r\}$ are the coordinate of the sound source and room, respectively.

The angle $(\theta_i, \varphi_i)$ between the each image source and the listener can be calculated as:

$$\theta_i = \arccos \frac{z_i - z_r}{\sqrt{(x_i - x_r)^2 + (y_i - y_r)^2 + (z_i - z_r)^2}}$$

$$\varphi_i = \arccos \frac{y_i - y_r}{x_i - x_r}$$

The attenuation of the early reflections is:

$$\alpha_i = \frac{1}{\sqrt{(x_i - x_r)^2 + (y_i - y_r)^2 + (z_i - z_r)^2}}$$

The early reflection can be calculated as (N is the number of early reflections):

$$e_{left}(t) = \Sigma_{i=1}^{N} \alpha_i s''_{left}(t) * \mathrm{hrir}_{left}(t, \theta_i, \varphi_i))$$

$$e_{right}(t) = \Sigma_{i=1}^{N} \alpha_i s''_{right}(t) * \mathrm{hrir}_{right}(t, \theta_i, \varphi_i))$$

t is the time, $\theta_i$, $\varphi_i$ are azimuth and elevation angles, respectively. * denotes for convolution in time domain.

In one embodiment, the obtaining the stereo signal comprises: obtaining an initial audio signal; decomposing the initial audio signal, using one or any combination of the following methods: Ambient Phase Estimation, Principal Component Analysis or Least Squares Analysis, to obtain the stereo signal and an ambient signal; wherein the method further comprises: obtaining a left channel signal and a right channel signal by up-mixing the stereo signal; adding the ambient signal with the left channel signal, to obtain a left sum signal; adding the ambient signal with the right channel signal, to obtain a right sum signal; processing the left sum signal and the right sum signal, according to two pairs of head related transfer functions, to obtain a processed left channel signal and a processed right channel signal; processing the filtered center channel signal, according to a pair of head related transfer functions, to obtain a processed center channel signal; and wherein the generating a binaural signal based on the filtered center channel signal comprises: generating a left signal of the binaural signal based on the processed left channel signal and the processed center channel signal, generating a right signal of the binaural signal based on the processed right channel signal and the processed center channel signal.

In one embodiment, the method further comprises: filtering the left channel signal, the right channel signal and the center channel signal, using one or more decorrelation filters, to obtain a decorrelated left signal, a decorrelated right signal and a decorrelated center signal; and obtaining a reflection signal based on the decorrelated left signal, the decorrelated right signal and the decorrelated center signal.

In one embodiment, the method further comprises: obtaining a left channel signal and a right channel signal by up-mixing the stereo signal; convolving the stereo signal with a local reverberation to obtain a convolved stereo signal; adding the convolved stereo signal with the left channel signal, to obtain a left sum signal; adding the convolved stereo signal with the right channel signal, to obtain a right sum signal; processing the left sum signal and the right sum signal, according to two pairs of head related transfer functions, to obtain a processed left channel signal and a processed right channel signal; processing the filtered center channel signal, according to a pair of head related transfer functions, to obtain a processed center channel signal; and wherein the generating a binaural signal based on the filtered center channel signal comprises: generating a left signal of the binaural signal based on the processed left channel signal and the processed center channel signal, generating a right signal of the binaural signal based on the processed right channel signal and the processed center channel signal.

In one embodiment, the method further comprises: filtering the left channel signal, the right channel signal and the center channel signal, using one or more decorrelation filters, to obtain a decorrelated left signal, a decorrelated right signal and a decorrelated center signal; and obtaining a reflection signal based on the decorrelated left signal, the decorrelated right signal and the decorrelated center signal.

In one embodiment, the method further comprises: obtaining a left channel signal and a right channel signal by up-mixing the stereo signal; convolving the stereo signal with a local reverberation to obtain a convolved stereo signal; processing the left channel signal and the right channel signal, according to two pairs of head related transfer functions, to obtain a processed left channel signal and a processed right channel signal; processing the filtered center channel signal, according to a pair of head related transfer functions, to obtain a processed center channel signal; and wherein the generating a binaural signal based on the filtered center channel signal comprises: generating a left signal of the binaural signal based on the processed left channel signal, the convolved stereo signal and the processed center channel signal, generating a right signal of the binaural signal based on the processed right channel signal, the convolved stereo signal and the processed center channel signal.

In one embodiment, the method further comprises: filtering the left channel signal, the right channel signal and the center channel signal, using one or more decorrelation filters, to obtain a decorrelated left signal, a decorrelated right signal and a decorrelated center signal; and obtaining a reflection signal based on the decorrelated left signal, the decorrelated right signal and the decorrelated center signal.

In one embodiment, late reverberation e.g., calculated by convolution with late reverberation synthesized or recorded in the room ($h_{late,left}(t)$, $h_{late,right}(t)$) is performed according to the following formula:

$$l_{left}(t)=s(t)*h_{late,left}(t)=\int_{-\infty}^{\infty}h_{late,left}(t-\tau)s(\tau)d\tau$$

$$l_{right}(t)=s(t)*h_{late,right}(t)=\int_{-\infty}^{\infty}h_{late,right}(t-\tau)s(\tau)d\tau$$

This is a convolution formula in time domain. t denotes for time. * denotes for convolution in time domain. t denotes for time, $\tau$ is a variable, which should be integrated from $-\infty$ to $\infty$. $d\tau$ stands for the smallest piece of the variable $\tau$. s(t) is the input signal in time domain.

In one embodiment, the binaural signals are the sum of direct sound, early reflections and late reverberation:

$$\text{Left}=d_{left}(t)+e_{left}(t)+l_{left}(t)$$

$$\text{Right}=d_{right}(t)+e_{right}(t)+l_{right}(t)$$

Figure 20:
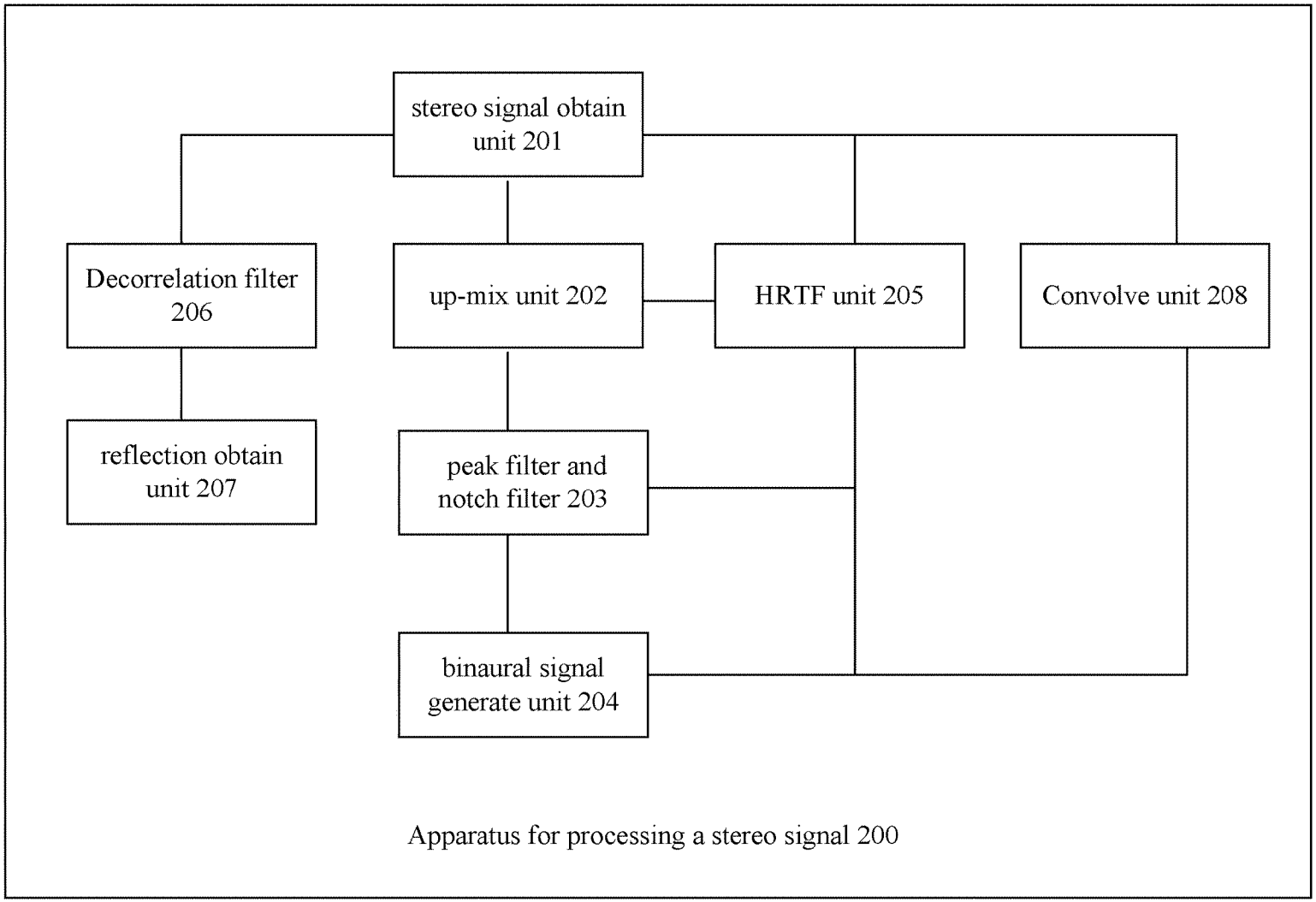
FIG. 20 shows a schematic diagram illustrating an apparatus for processing a stereo signal according to an embodiment.

FIG. 20 shows a schematic diagram of an apparatus for processing a stereo signal according to an embodiment. The apparatus comprises: a stereo signal obtain unit configured to obtain the stereo signal; a up-mix unit configured to obtain a center channel signal by up-mixing the stereo signal; one or more peak filters and one or more notch filters configured to filter the center channel signal to obtain a filtered center channel signal; and a binaural signal generate unit (204) configured to generate a binaural signal based on the filtered center channel signal.

In one embodiment, the up-mix unit is further configured to obtain a side channel signal by up-mixing the stereo signal; the apparatus further comprises a head related transfer function, HRTF, unit, the HRTF unit is configured to process the side channel signal, according to a first head related transfer function, to obtain a processed side channel signal; the HRTF unit is further configured to process the filtered center channel signal, according to a second head related transfer function, to obtain a processed center channel signal; and the binaural signal generate unit is configured to generate the binaural signal based on the processed side channel signal and the processed center channel signal.

In one embodiment, the up-mix unit is further configured to obtain a left channel signal and a right channel signal by up-mixing the stereo signal; the apparatus further comprises a head related transfer function, HRTF, unit, the HRTF unit is configured to process the left channel signal and the right channel signal, according to two pairs of head related transfer functions, to obtain a processed left channel signal and a processed right channel signal; the HRTF unit is further configured to process the filtered center channel signal, according to a pair of head related transfer functions, to obtain a processed center channel signal; and the binaural signal generate unit is configured to generate a left signal of the binaural signal based on the processed left channel signal and the processed center channel signal, the binaural signal generate unit is configured to generate a right signal of the binaural signal based on the processed right channel signal and the processed center channel signal.

In one embodiment, the apparatus further comprises:

one or more decorrelation filters configured to filter the side channel signal and the center channel signal, to obtain a decorrelated side signal and a decorrelated center signal; and a reflection obtain unit configured to obtain a reflection signal based on the decorrelated side signal and the decorrelated center signal.

In one embodiment, the apparatus further comprises:

one or more decorrelation filters configured to filter the left channel signal, the right channel signal and the center channel signal, to obtain a decorrelated left signal, a decorrelated right signal and a decorrelated center signal; and a reflection obtain unit configured to obtain a reflection signal based on the decorrelated left signal, the decorrelated right signal and the decorrelated center signal.

In one embodiment, the stereo signal obtain unit is configured to obtain an initial audio signal, and decompose the initial audio signal, using one or any combination of the following methods: Ambient Phase Estimation, Principal Component Analysis or Least Squares Analysis, to obtain the stereo signal.

In one embodiment, the stereo signal obtain unit is configured to obtain an initial audio signal, decompose the initial audio signal, using one or any combination of the following methods: Ambient Phase Estimation, Principal Component Analysis or Least Squares Analysis, to obtain the stereo signal and an ambient signal;

the up-mix unit is further configured to obtain a left channel signal and a right channel signal by up-mixing the stereo signal;

the apparatus further comprises a head related transfer function, HRTF, unit, the HRTF unit is configured to add the ambient signal to the left channel signal, to obtain a left sum signal, add the ambient signal to the right channel signal, to obtain a right sum signal;

the HRTF unit is further configured to process the left sum signal and the right sum signal, according to two pairs of head related transfer functions, to obtain a processed left channel signal and a processed right channel signal, and the HRTF unit is further configured to process the filtered center channel signal, according to a pair of head related transfer functions, to obtain a processed center channel signal; and wherein the binaural signal generate unit is configured to generate a left signal of the binaural signal based on the processed left channel signal and the processed center channel signal, generate a right signal of the binaural signal based on the processed right channel signal and the processed center channel signal.

In one embodiment, the apparatus further comprises:

one or more decorrelation filters configured to filter the left channel signal, the right channel signal and the center channel signal, to obtain a decorrelated left signal, a decorrelated right signal and a decorrelated center signal; and a reflection obtain unit configured to obtain a reflection signal based on the decorrelated left signal, the decorrelated right signal and the decorrelated center signal.

In one embodiment, the up-mix unit is further configured to obtain a left channel signal and a right channel signal by up-mixing the stereo signal;

the apparatus further comprises a convolve unit, the convolve unit is configured to convolve the stereo signal with a local reverberation to obtain a convolved stereo signal;

the apparatus further comprises a head related transfer function, HRTF, unit, the HRTF unit is configured to add the convolved stereo signal with the left channel signal, to obtain a left sum signal, add the convolved stereo signal with the right channel signal, to obtain a right sum signal;

the HRTF unit is further configured to process the left sum signal and the right sum signal, according to two pairs of head related transfer functions, to obtain a processed left channel signal and a processed right channel signal, and the HRTF unit is further configured to process the filtered center channel signal, according to a pair of head related transfer functions, to obtain a processed center channel signal; and wherein the binaural signal generate unit is configured to generate a left signal of the binaural signal based on the processed left channel signal and the processed center channel signal, generate a right signal of the binaural signal based on the processed right channel signal and the processed center channel signal.

In one embodiment, the apparatus further comprises:

one or more decorrelation filters configured to filter the left channel signal, the right channel signal and the center channel signal, to obtain a decorrelated left signal, a decorrelated right signal and a decorrelated center signal; and a reflection obtain unit configured to obtain a reflection signal based on the decorrelated left signal, the decorrelated right signal and the decorrelated center signal.

In one embodiment, the up-mix unit is further configured to obtain a left channel signal and a right channel signal by up-mixing the stereo signal;

the apparatus further comprises a convolve unit, the convolve unit is configured to convolve the stereo signal with a local reverberation to obtain a convolved stereo signal;

the apparatus further comprises a head related transfer function, HRTF, unit, the HRTF unit is configured to process the left channel signal and the right channel signal, according to two pairs of head related transfer functions, to obtain a processed left channel signal and a processed right channel signal;

the HRTF unit is further configured to process the filtered center channel signal, according to a pair of head related transfer functions, to obtain a processed center channel signal; and wherein the binaural signal generate unit is configured to generate a left signal of the binaural signal based on the processed left channel signal, the convolved stereo signal and the processed center channel signal, generate a right signal of the binaural signal based on the processed right channel signal, the convolved stereo signal and the processed center channel signal.

In one embodiment, the apparatus further comprises:

one or more decorrelation filters configured to filter the left channel signal, the right channel signal and the center channel signal, to obtain a decorrelated left signal, a decorrelated right signal and a decorrelated center signal; and a reflection obtain unit configured to obtain a reflection signal based on the decorrelated left signal, the decorrelated right signal and the decorrelated center signal.

In one embodiment, one or more peak filters and one or more notch filters, comprises:

a notch filter centered at a frequency between 4 kHz and 8 kHz and having a 1-octave bandwidth, a first peak filterer centered at 4 kHz and having a ⅓-octave bandwidth, and a second peak filter centered at a frequency above 13 kHz and having a ¼-octave bandwidth.

In one embodiment, the one or more peak filters and one or more notch filters, comprises:

a first notch filter centered at 9 kHz and having a ¼-octave bandwidth, a second notch filter centered at 16 kHz and having a ¼-octave bandwidth, a first peak filter centered at 1 kHz and having a ⅓-octave bandwidth, and a second peak filter centered at a frequency between 10 and 12 kHz and having a ¼-octave bandwidth.

The method according to the embodiments of the disclosure (for example, according to the embodiments disclosed in FIG. 19) can be performed by the apparatus 200 according to the embodiments of the disclosure. Further features of the method according to the embodiments of the disclosure result directly from the functionality of the apparatus 200 according to the embodiments of the disclosure and its different embodiments and/or implementation forms.

Figure 21:
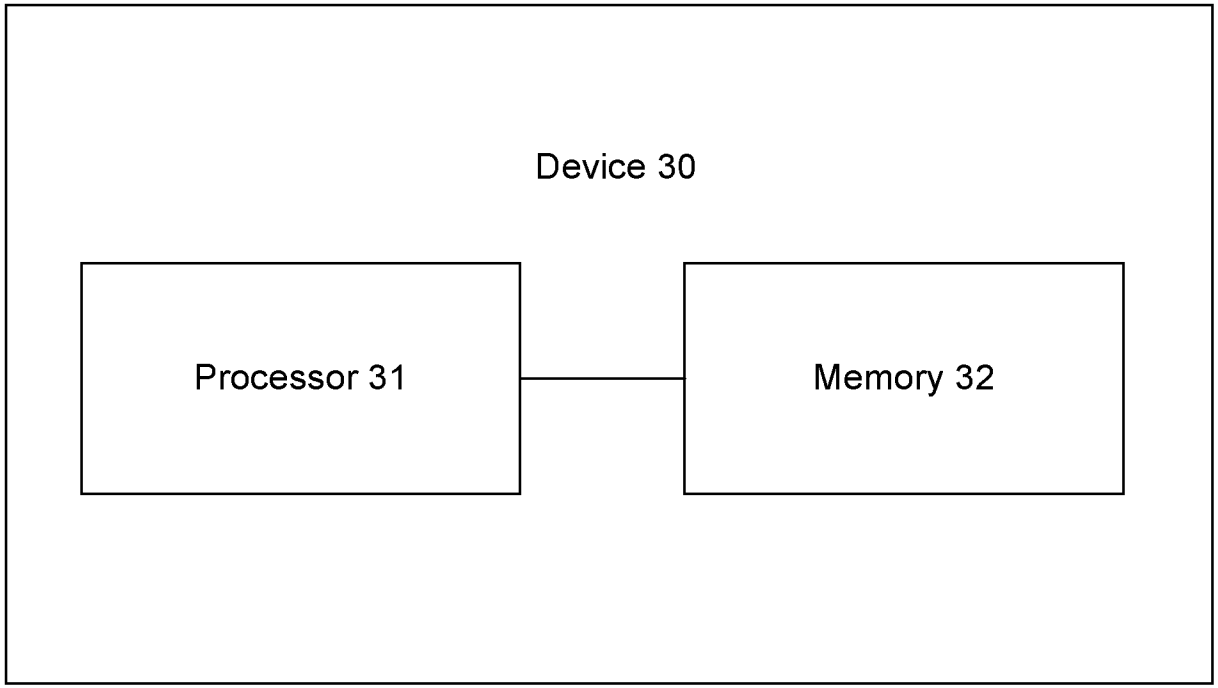
FIG. 21 shows a schematic diagram illustrating a device for processing a stereo signal according to an embodiment.

FIG. 21 shows a schematic diagram of a device 30 for processing a stereo signal according to an embodiment. The device 30 comprises a processor 31 and a computer-readable storage medium 32 storing program code. The program code comprises instructions for carrying out embodiments of the method for processing a stereo signal or one of its embodiments and/or implementations.

In an example, as shown in FIG. 2, externalization is enhanced and front-back confusion of binaurally rendered sound sources is reduced. In this embodiment, the input signals 21 may be a mono dry signal, a mono wet signal, stereo dry signals or stereo wet signals, or others. After the processing of the input signals by using methods disclosed herein (Binaural rendering with externalization & Localization enhancement method 22), a pair of binaural signals 23 for left and right ears is generated, which are then played pack over headphones.

Figure 3:
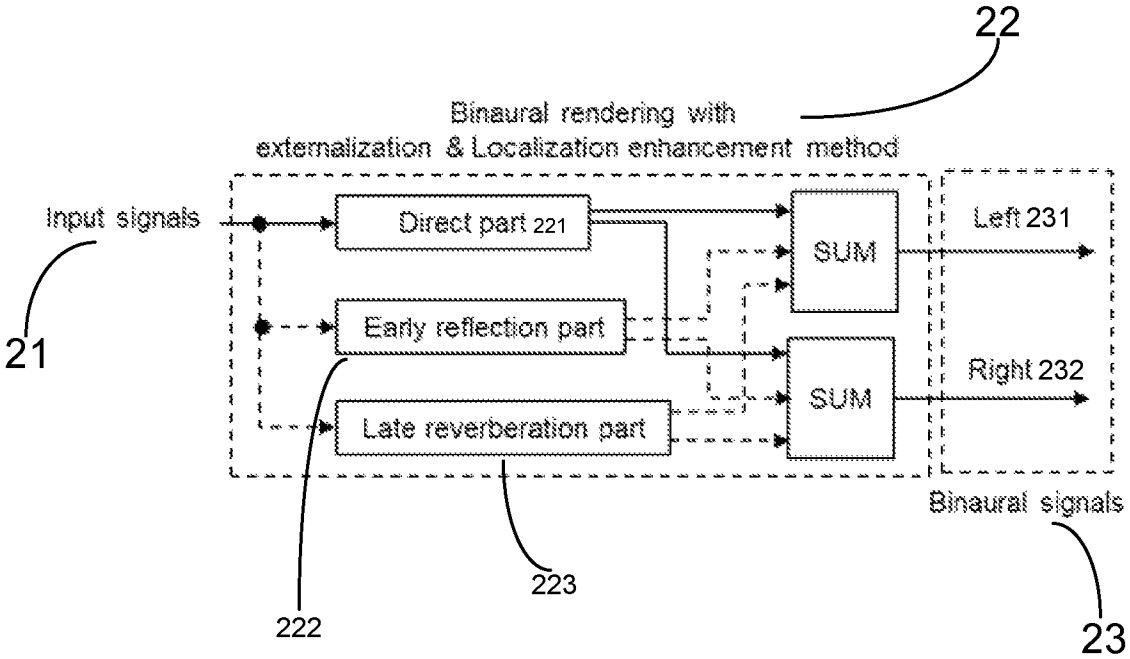
FIG. 3 shows another schematic diagram of a method of binaural rendering with externalization and localization enhancement method according to an embodiment.

In an example, a sound field can be divided into three parts: a direct part 221, an early reflection part 222 and a late reverberation part 223. The direct sound part 221 is essential for the sound source localization; the early reflection part 222 is still direction dependent, which provides spatial information, and is important for perception of externalization of sound sources. The late reverberation part 223 provides room information to listeners, and does not depend on the position of sound sources and listeners any more. These three parts should be simulated separately (see FIG. 3). To generate a virtual sound source in a free-field, there is no need to simulate the early reflections and the late reverberation. In contrast, the early reflections and the late reverberation are required to simulate a reverberant virtual sound source (with room information).

Figure 4:
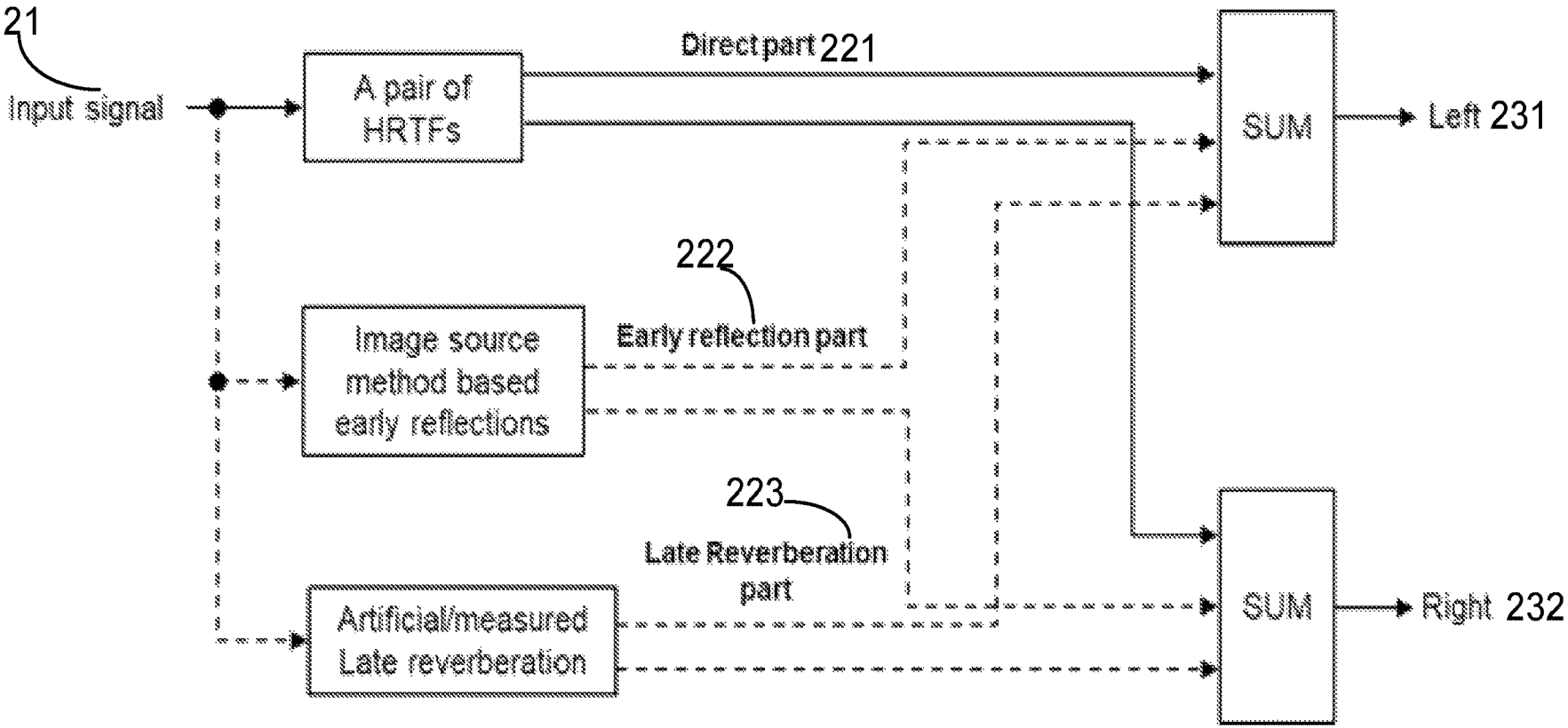
FIG. 4 shows a block diagram of a general method to simulate a virtual sound source according to an embodiment.

FIG. 4 shows the block diagram of a general method to simulate a virtual sound source. The direct sound part 221 is simulated by filtering the input signal through a pair of HRTFs. There are several methods to simulate the early reflection part 222, such as image source methods or ray tracing methods. Image source methods are commonly applied for real-time rendering of 3D audio. To simulate the early reflection part 222, some prerequisite, i.e., the positions of sound sources and listeners and the geometry of the room should be estimated or predefined. The late reverberation part 223 can be realized by using, for example, an artificial reverberator (e.g., based on a feedback delay network), or measured or synthesized late reverberation.

The embodiments of the present disclosure improve the externalization and reduce front-back confusion of binaurally rendered sound sources. Compared to the conventional method (for example, the method described with reference to FIG. 4), in the case of a mono sound source, the direct sound and the early reflections are additionally processed through peak and notch filters and decorrelation filters, respectively. In the case of stereo signals, the extracted phantom center signal is additionally filtered through peak and notch filters and together with the side signals to simulate the direct sound part. The early reflections are simulated by decorrelating the phantom center signal and the side signals and applying room geometric methods, e.g. image source method. Furthermore, for the augmented reality (AR) application, the ambient sound in the original signal is replaced by the reverberation in the current room.

Figure 5:
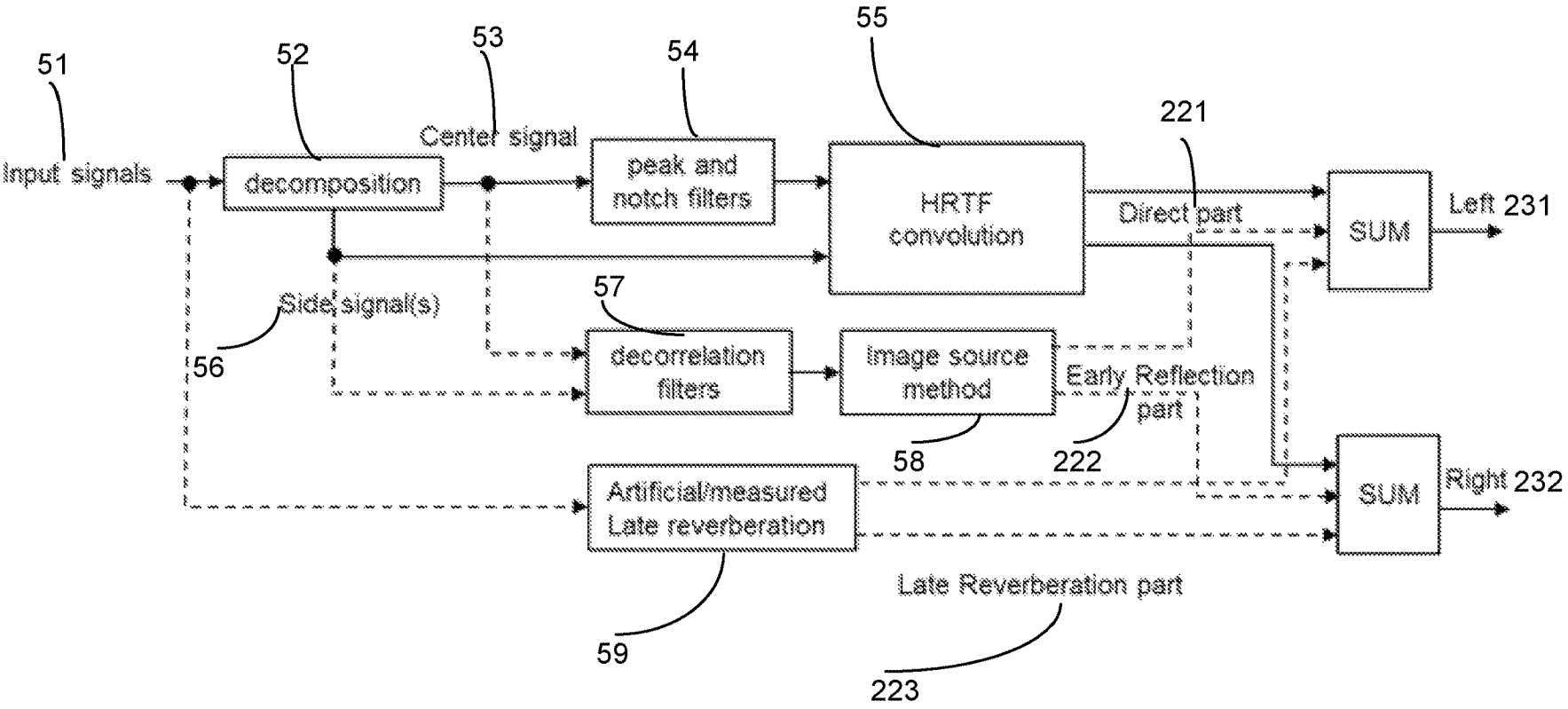
FIG. 5 shows another schematic diagram of a method of binaural rendering with externalization and localization enhancement method according to an embodiment.

In one embodiment, FIG. 5 shows a signal processing scheme according to an embodiment of the present disclosure in the case of a stereo signal scenario. The input signal 51 is decomposed (in block 52, e.g., using an up-mix method) into a center signal 53 and one or more side signals 56. A peak and notch filter 54 is applied to the direct sound part (direct part 221) of the center signal 53 (i.e. the center channel signal). The peak and notch filter 54 may comprise (or be equivalent to) a filter chain comprising one or more peak filters and one or more notch filters. The decorrelation filters 57 are applied to the center signal 53 and to the one or more side signal(s) in order to simulate the early reflections (early reflection part 222) of the center signal 53 and the one or more side signals 56. The center signal 53 (after passing through by the peak and notch filter 54) and the one or more side signal 56 are each filtered with HRTFs 55 to generate a direct sound part 221. The early reflections are simulated by decorrelating 57 the center signal 53 and the side signals 56 and applying room geometric methods, e.g., an image source method 58. The late reverberation part 223 can be simulated using artificial reverberators, e.g. a feedback delay network, or using a measured or synthesized late reverberation part. The rendering process may be performed in mobile devices.

In an example, according to the psychoacoustic experiments, it can be observed that some special frequency components were correlated with the subjective impression on the sound source localization in the median plane. The experimental results may be summarized as: (1) Frontal localization is cued by a 1-octave notch having a lower cut-off frequency between 4 kHz and 8 kHz and increased energy above 13 kHz. (2) A sound source passing by a ¼-octave peak filter between 7 and 9 kHz is perceived as a sound located above. (3) A sound source filtered by a peak filter between 10 and 12 kHz is perceived as a sound located behind. The "directional band" indicated that 500 Hz and 4 kHz were related to the frontal localization, 1 kHz and 8 kHz were related to behind and above perception, respectively.

Figure 6:
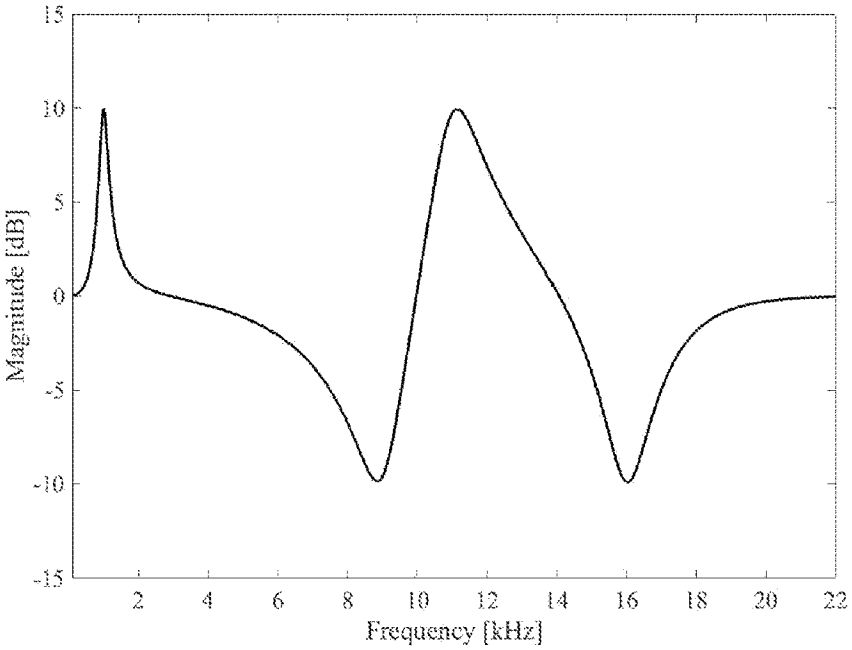
FIG. 6 shows an example of magnitude spectra of peak notch filter for a frontal (left panel) and rear (right panel) sound source.
Figure 6:
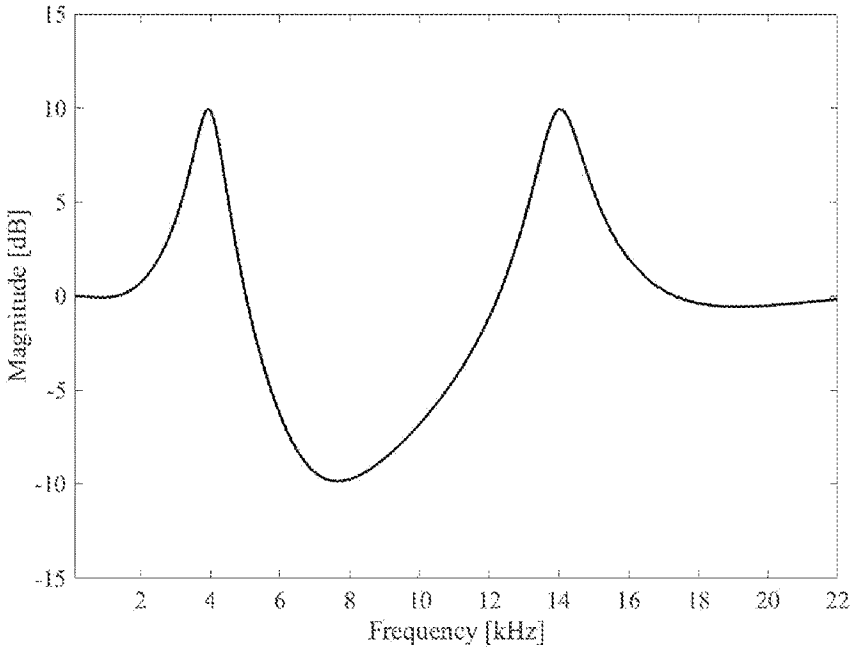

In an example, based on psychoacoustic experiments, a peak notch filter is designed to amplify the directional band information, thus to enhance the accuracy of sound source localization and reduce the front-back confusion for frontal and rear sound sources. The details of the peak and notch filter are: a notch filter centered at 7 kHz and having a 1-octave bandwidth, a peak filter centered at 4 kHz and having a ⅓-octave bandwidth and a peak filter centered at 14 kHz and having a ¼-octave bandwidth are designed for a frontal sound source; a peak filter centered at 1 kHz and having a ⅓-octave bandwidth, a notch filter centered at 9 kHz and having a ¼-octave bandwidth, a peak filter centered at 11 kHz and having a ¼-octave bandwidth and a notch filter centered at 16 kHz and having a ¼-octave bandwidth for a rear sound source. The audio quality and the localization performance both depend highly on the gain factors in the peak and notch filters. For example, +/−10 dB gain factors can be applied to achieve the trade-off between sound timbre coloration and the accuracy of sound localization. FIG. 6 shows an example of magnitude spectra of a peak notch filter designed for a frontal (left panel) and rear (right panel) sound source, respectively.

Figure 7:
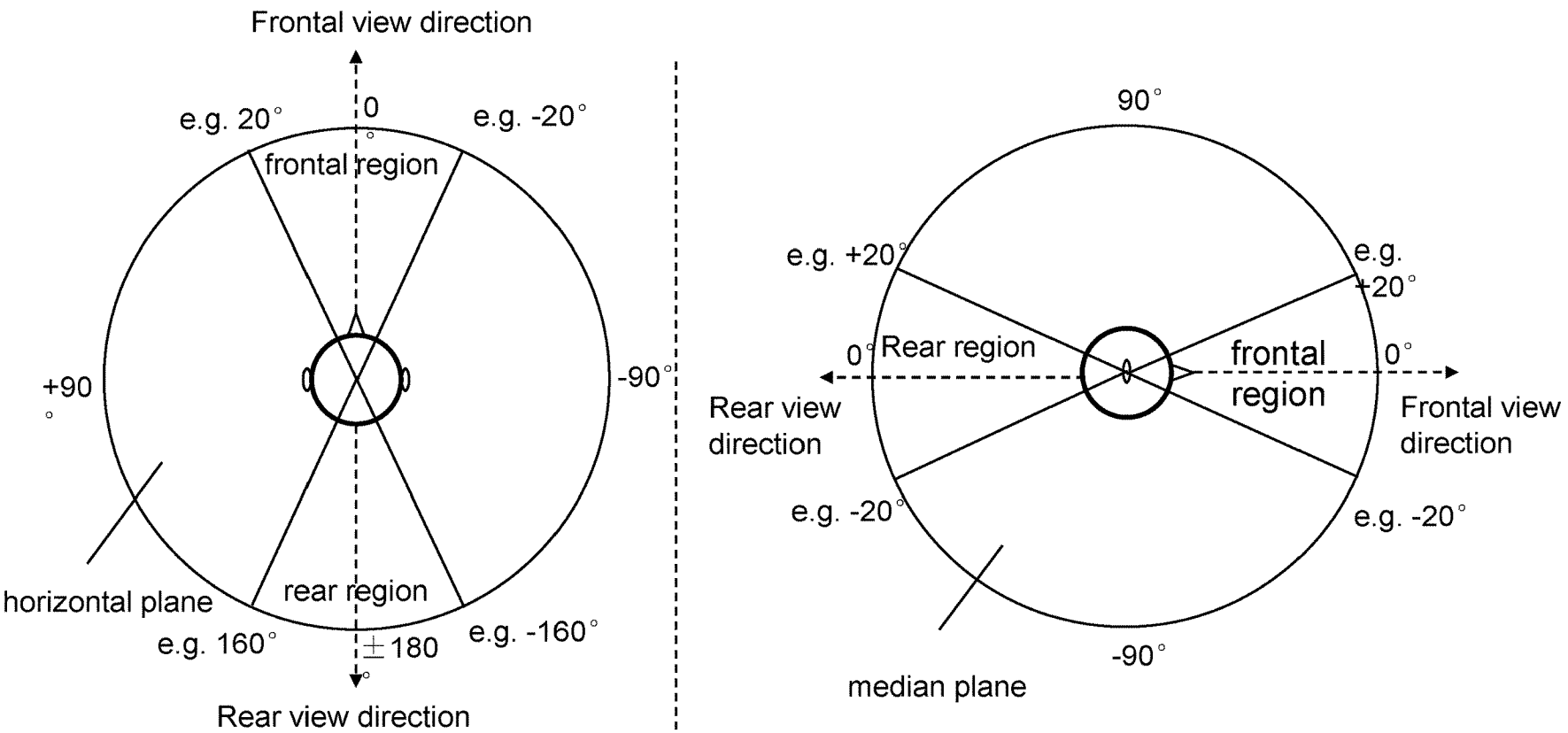
FIG. 7 shows an example of frontal and rear view direction in a rendering system.

The peak and notch filters are only applied to the sound source in the frontal and rear regions, which is defined between, e.g., −20° and 20° in the horizontal and median plane around the frontal and rear view direction (see FIG. 7) in the rendering system. The frontal and rear regions are illustrated in FIG. 7.

Figure 8:
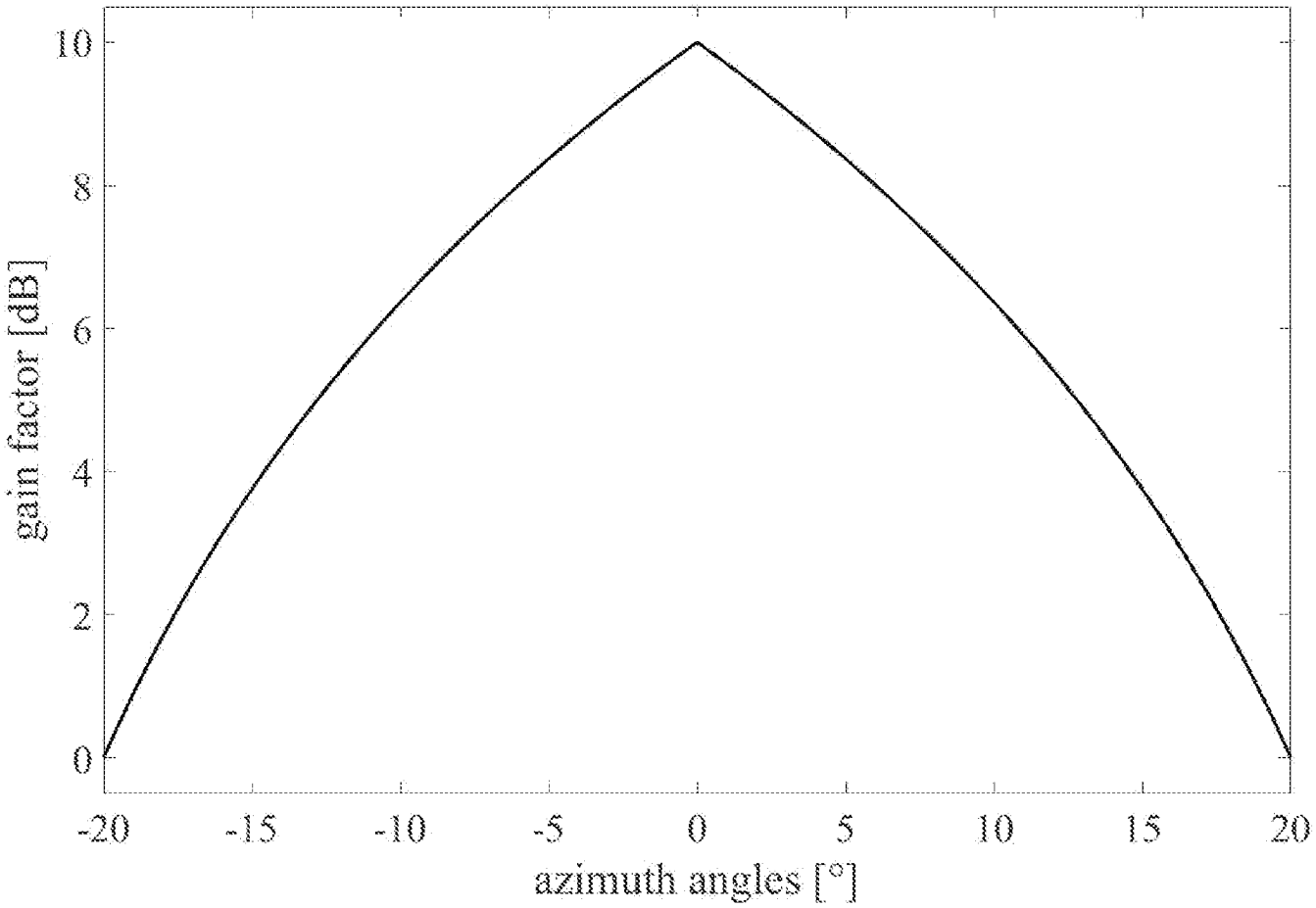
FIG. 8 shows an example of the gain factor across different azimuth angles (θ) for the sound source located on the horizontal plane.

In the case of a lateral sound source, the gain factor of the filters should be set to zero. To avoid the jump between frontal and lateral sound source, azimuth and elevation depending gain factors are considered. The gain factors $G_f f(\theta, \varphi)$ and $G_r f(\theta, \varphi)$ for the frontal and rear regions are expressed as:

$$g_f(\theta, \varphi) = \begin{cases} a|\theta| + b|\varphi| + c|\theta\varphi| + d, & \text{for } |\theta| \le 20^\circ, |\varphi| \le 20^\circ \\ 1, & \text{otherwise} \end{cases}, \quad \text{(Eq. 1)}$$

$$g_r(\theta, \varphi) = \begin{cases} a(180^\circ - |\theta| + b|\varphi| + c(180^\circ - |\theta|)|\varphi| + d, & \text{for } |\theta| \ge 160^\circ, |\varphi| \le 20^\circ \\ 1, & \text{otherwise} \end{cases},$$

$$\text{with } G_f(\theta, \varphi) = 20 \log_{10}(g_f(\theta, \varphi)), \quad \text{(Eq. 2)}$$
$$G_r(\theta, \varphi) = 20 \log_{10}(g_r(\theta, \varphi)),$$

where θ and φ denote the azimuth and elevation angles, respectively. $G_f(\theta, \varphi)$ and $G_r(\theta, \varphi)$ represent the gain factors in the peak and notch filters for the frontal and rear sound sources, respectively. The parameters a, b, c and d are for example: −0.1081, −0.1081, 0.0054 and 3.1623, respectively. FIG. 8 shows an example of the gain factor across different azimuth angles (θ) for the sound source located on the horizontal plane (elevation angle φ=0°).

While the above mentioned peak and notch filter is considered for the frontal and rear sound sources to reduce front-back confusion, it should be noted that the peak and notch filter can also be designed for a virtual sound source located above the head to reduce up-down confusion.

The decorrelation filters, which simulate early reflections, have the effect of increasing the binaural reverberation cues, i.e. the fluctuations of Interaural-level difference (ILD) and the Interaural coherence (IC) between two ear signals in critical bands, and further to improve perceived externalization of 3D audio reproduction over headphones.

Figure 9:
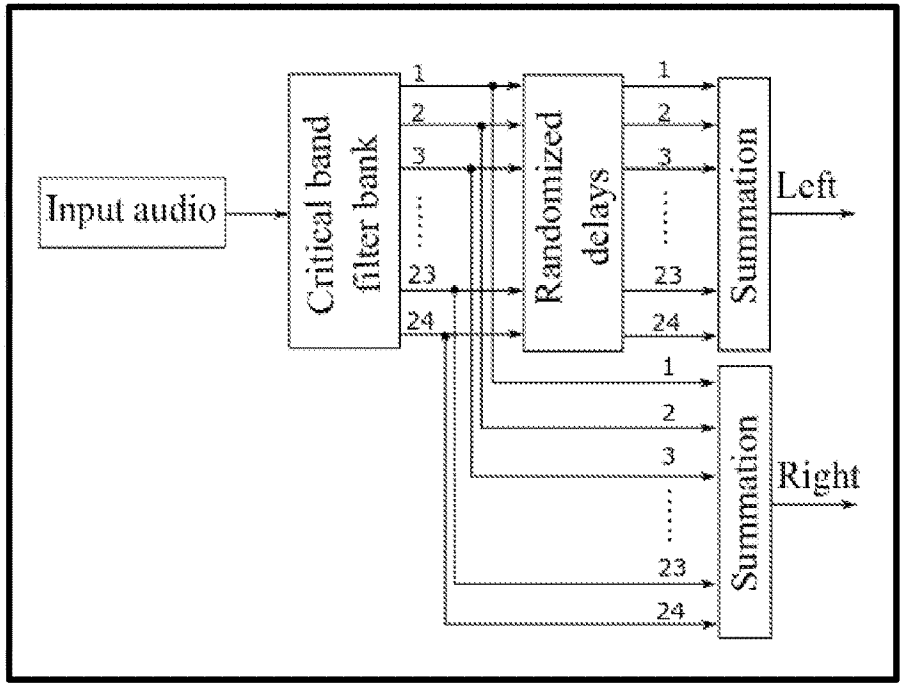
FIG. 9 shows a schematic diagram of a method to decorrelate the input audio signal according to an embodiment.
Figure 9:
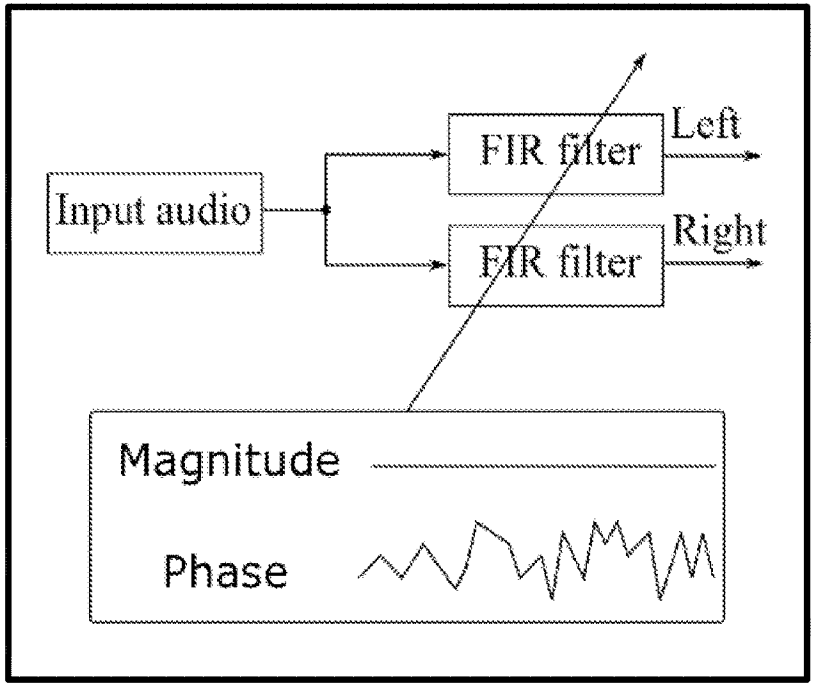

The input audio signal can be decorrelated by using a pair of static or dynamic FIR all-pass filters (see FIG. 9, left panel). One disadvantage of that method is, however, that a uniform magnitude spectrum cannot be guaranteed due to the phase variation in the filter. To avoid this problem, a decorrelation method based on a filter bank is disclosed. In this method, the input audio signal was divided into 24 critical bands by applying an equivalent rectangular band (ERB) filter bank. In each frequency band a random delay was applied (see FIG. 9, right panel). After that, the audio signals in each frequency bands are summed back together.

The pair of time varying decorrelation filters (random phase FIR filter or filter bank based decorrelation filters) is applied for the early reflections to improve the perceived externalization and spaciousness on the virtual sound source, especially for frontal and rear sound sources (based on our experiments).

Embodiment 1

Rendering of a Mono Dry Sound Source without Room Information.

Figure 10:
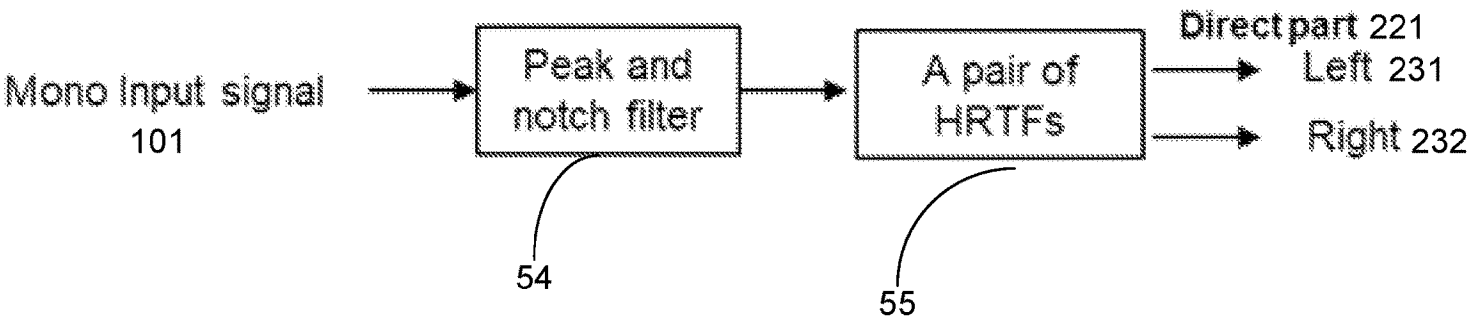
FIG. 10 shows a schematic diagram of a method to enhancement of externalization of a mono signal according to an embodiment.

FIG. 10 shows an embodiment of the enhancement of externalization of a mono dry signal without room information. A mono input signal 101 is filtered through a peak and notch filter 54 which depends on the azimuth and elevation angles of the sound source. The filtered signal is further filtered through a pair of HRTFs 55 of the desired azimuth and elevation angles to simulate a virtual sound source. For a dynamic binaural rendering system (binaural rendering coupled with head tracking devices), the HRTF and the gain factors of the peak and notch filter should be changed in real-time as a function of the relative position between the simulated virtual sound source and the listener's head.

Embodiment 2

Rendering of a Mono Dry Sound Source with Additional Room Information.

Figure 11:
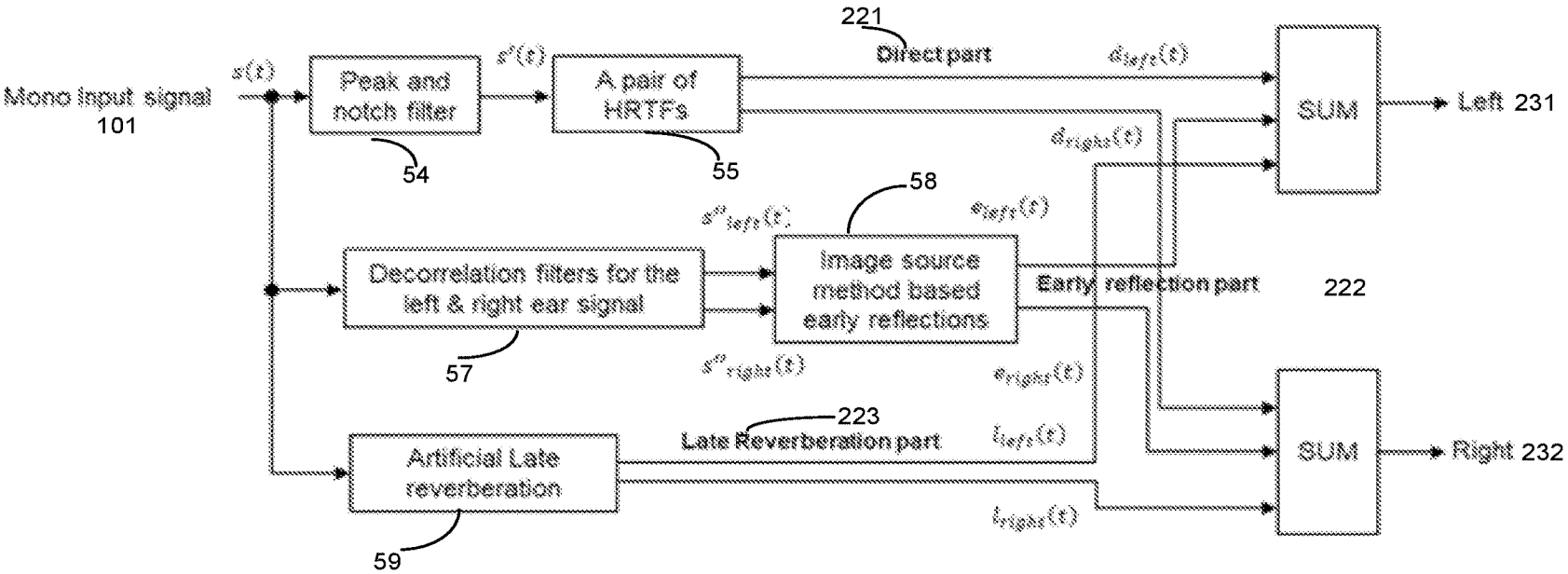
FIG. 11 shows another schematic diagram of a method to enhancement of externalization of a mono signal according to an embodiment.

Embodiment 1 (FIG. 10) aims to simulate the virtual sound source in a free-field (without room information). FIG. 11 shows an example of a method of enhancing externalization of a mono dry signal with additional room information. The direct sound part 221 may be the same as in Embodiment 1, i.e. the input signal 101 is filtered through the peak and notch filter 54 and further filtered through a pair of HRTFs 55. To simulate the early reflections, some characteristics such as the positions of sound sources and listeners and the geometry of the room should be estimated or predefined. In this embodiment, the mono input signal 101 is first decorrelated by applying a pair of decorrelation filters 57. The decorrelated left and right signals are then used to generate the early reflection part 222, e.g., using an image source method 58. Late reverberation can be generated using a feedback delay network based artificial reverberator to measure or synthesize late reverberation. The direct sound 221, early reflections 222 and late reverberation 223 are summed up to yield left 231 and right 232 ear signals. The ears signals 231 and 232 can be rendered by headphones.

Embodiment 3

Rendering of a Mono Wet Sound Source with Local Room Information for the AR Application.

Figure 12:
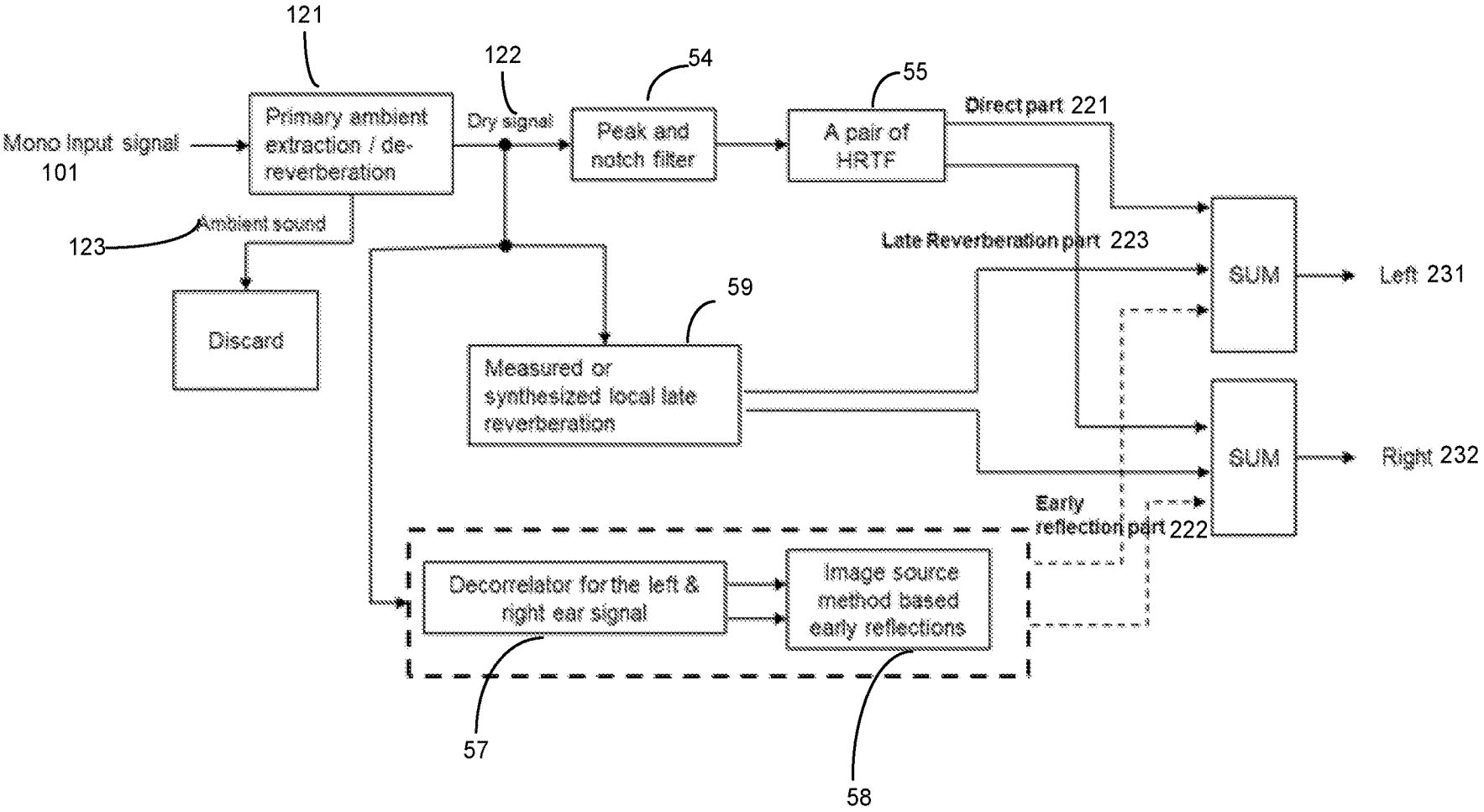
FIG. 12 shows another schematic diagram of a method to enhancement of externalization of a mono signal according to an embodiment.

FIG. 12 shows an example of a method of enhancing externalization of a mono wet signal with additional local room information. This wet input signal 101 contains the original ambient sound 123 (e.g., the noise in an airport, strong reverberation in a church, etc.) which is not consistent with the acoustic of the local room (e.g., in a conference room, bedroom, etc.). Therefore, the mono wet input signal 101 received by the user is decomposed into primary and ambient sound using, e.g., an Ambient Phase Estimation (APE) method, Principal Component Analysis (PCA) or a least squares (LS) methods. The extracted primary sound is considered as a dry signal 122 and the ambient signal is discarded. The primary sound signal is filtered through the peak and notch filter 54 and further filtered through a pair of HRTFs 55 to simulate the direct part 221 of the virtual sound source. To simulate the early reflections, the primary sound is decorrelated by applying a pair of decorrelation filters 57, then the decorrelation left and right signals are processed by using e.g., image source method 58. The late reverberation can be generated using a feedback delay network based artificial reverberator, to measure or synthesize late reverberation 59. The room acoustic parameters (e.g., reverberation time and mixing time) used to simulate the late reverberation part 223 may be consistent with those in the local room. At last, the direct sound (direct part 221), early reflections (early reflection part 222) and late reverberation (late reverberation part 223) are summed up for left 231 and right 232 ear signals, and played back through headphones.

Embodiment 4

Rendering of Stereo Dry Sound Sources without Room Information.

Figure 13:
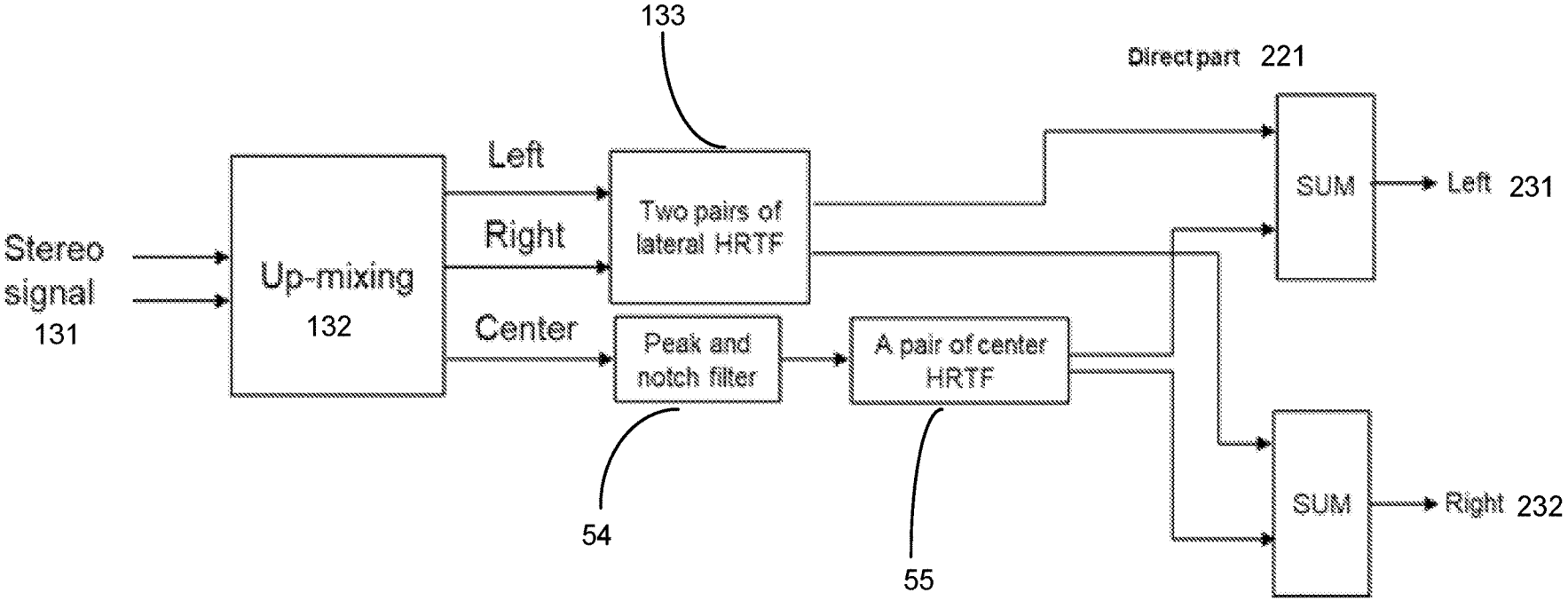
FIG. 13 shows a schematic diagram of a method to enhancement of externalization of a stereo signal according to an embodiment.

FIG. 13 shows an example of a method of enhancing externalization of stereo dry signals without room information. The stereo dry signals 131 are up-mixed 132 to center (i.e. center channel) and side (left channel and right channel) signals. The center signal is filtered through the peak and notch filter 54, and further filtered by a pair of center HRTFs 55, e.g., HRTFs at 0°. The side (left and right) signals are filtered through two pairs of lateral HRTFs 133, e.g., HRTFs at +/−30° (position of the virtual loudspeakers).

Embodiment 5

Rendering of Stereo Dry Sound Sources with Additional Room Information.

Figure 14:
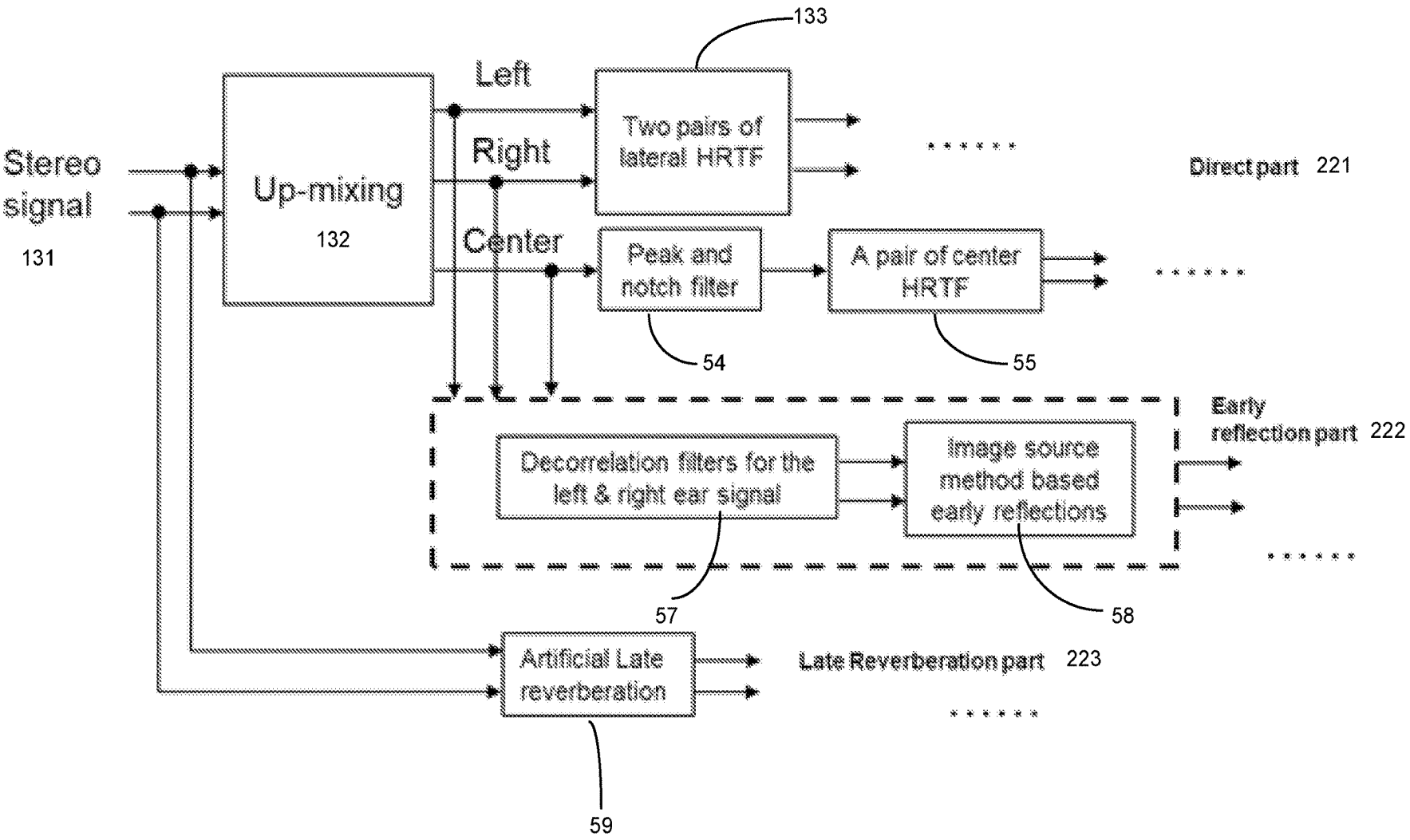
FIG. 14 shows another schematic diagram of a method to enhancement of externalization of a stereo signal according to an embodiment.

FIG. 14 shows an example of a method of enhancing externalization of stereo dry signals with additional room information. The stereo dry signals 131 are up-mixed 132 to center and side (left and right) signals. The center signal is filtered through the peak and notch filter 54, and further filtered by a pair of center HRTFs 55, e.g. HRTFs at 0°. The side (left and right) signals are filtered through two pairs of lateral HRTFs 133, e.g., HRTFs at +/−30° (position of the virtual loudspeakers). The signals in these three channels are filtered through decorrelation filters 57, and further processed to simulate early reflections using e.g., the image source method 58. For that, a simple room model is needed, e.g., width, length, height of the room, the position of the listener and sound source. The late reverberation can be generated using a feedback delay network based artificial reverberator, to measure or synthesize late reverberation 59. In FIG. 14, the input stereo signals are directly used to generate the late reverberation. It is also possible to use the upmixed signals (center and side signals) to create the late reverberation.

Embodiment 6

Rendering of Stereo Wet Sound Sources without Room Information.

Figure 15:
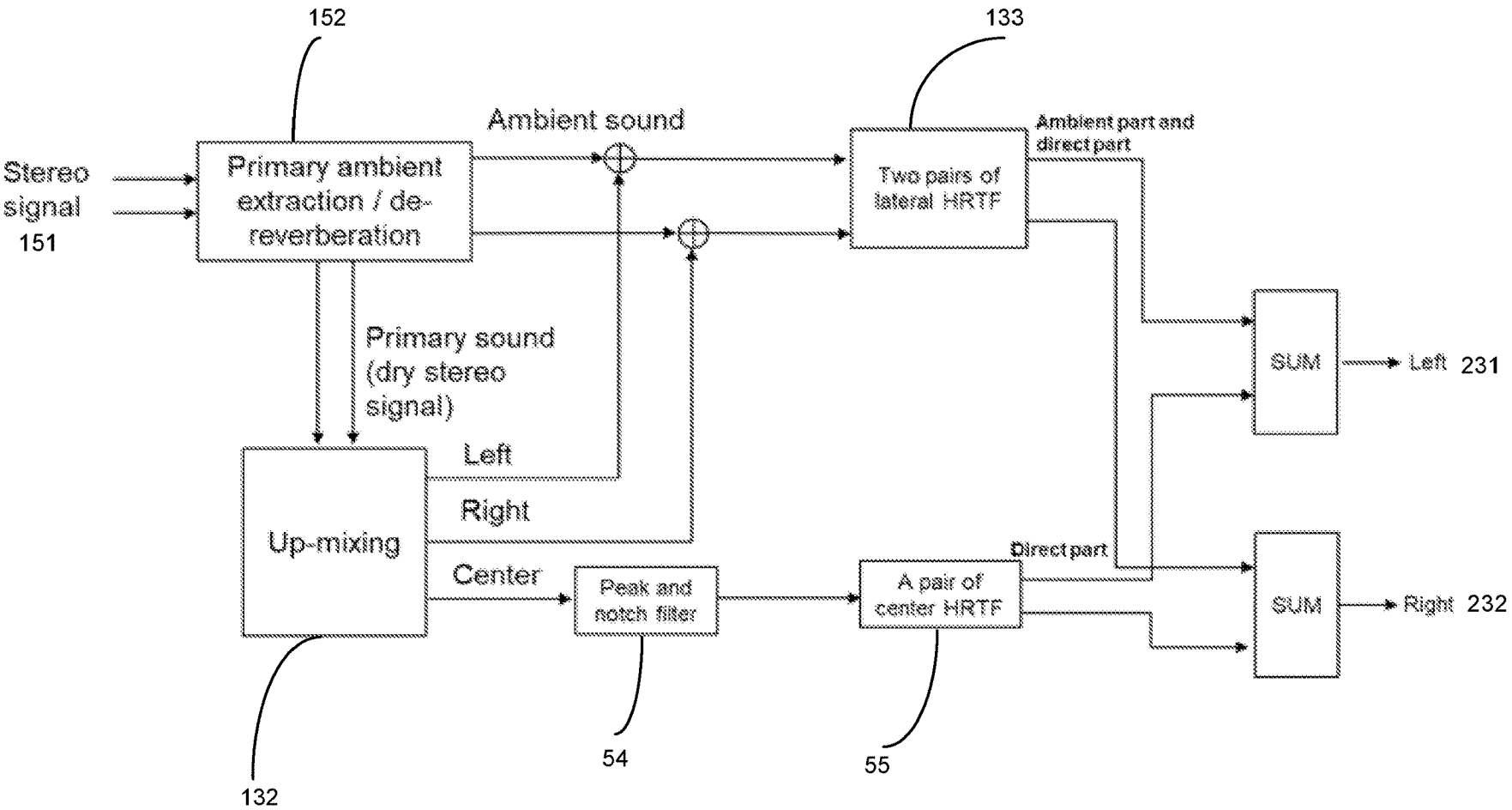
FIG. 15 shows another schematic diagram of a method to enhancement of externalization of a stereo signal according to an embodiment.

FIG. 15 shows an example of a method of enhancing externalization of stereo wet signals without room information. The primary and ambient signals from stereo wet signals 151 are extracted 152 using, e.g., an APE method, PCA, or a LS method, etc. The extracted primary sounds are considered as dry signals. Then the primary sounds are up-mixed 132 to the left, right and center signals. The center signal is filtered through the peak and notch filter 54, and is further filtered by a pair of center HRTF 55, e.g. HRTFs at 0°, resulting in left-ear center signal and a right-ear center signal. The side (left and right) signals and the ambient sound are summed up and filtered through two pairs of lateral HRTFs 133, e.g., HRTFs at +/−30° (position of the virtual loudspeakers), resulting in a left-ear "side plus ambient" signal and a right-ear "side plus ambient" signal. The left-ear center signal and the left-ear "side plus ambient" signal are summed up to produce a left-ear signal 231. Similarly, the right-ear center signal and the right-ear "side plus ambient" signal are summed up to produce a right-ear signal 232. Finally, the left-ear signal 231 and the right-ear signal 232 may be played back over headphones.

Embodiment 7

Rendering of Stereo Wet Sound Sources with Additional Room Information.

Figure 16:
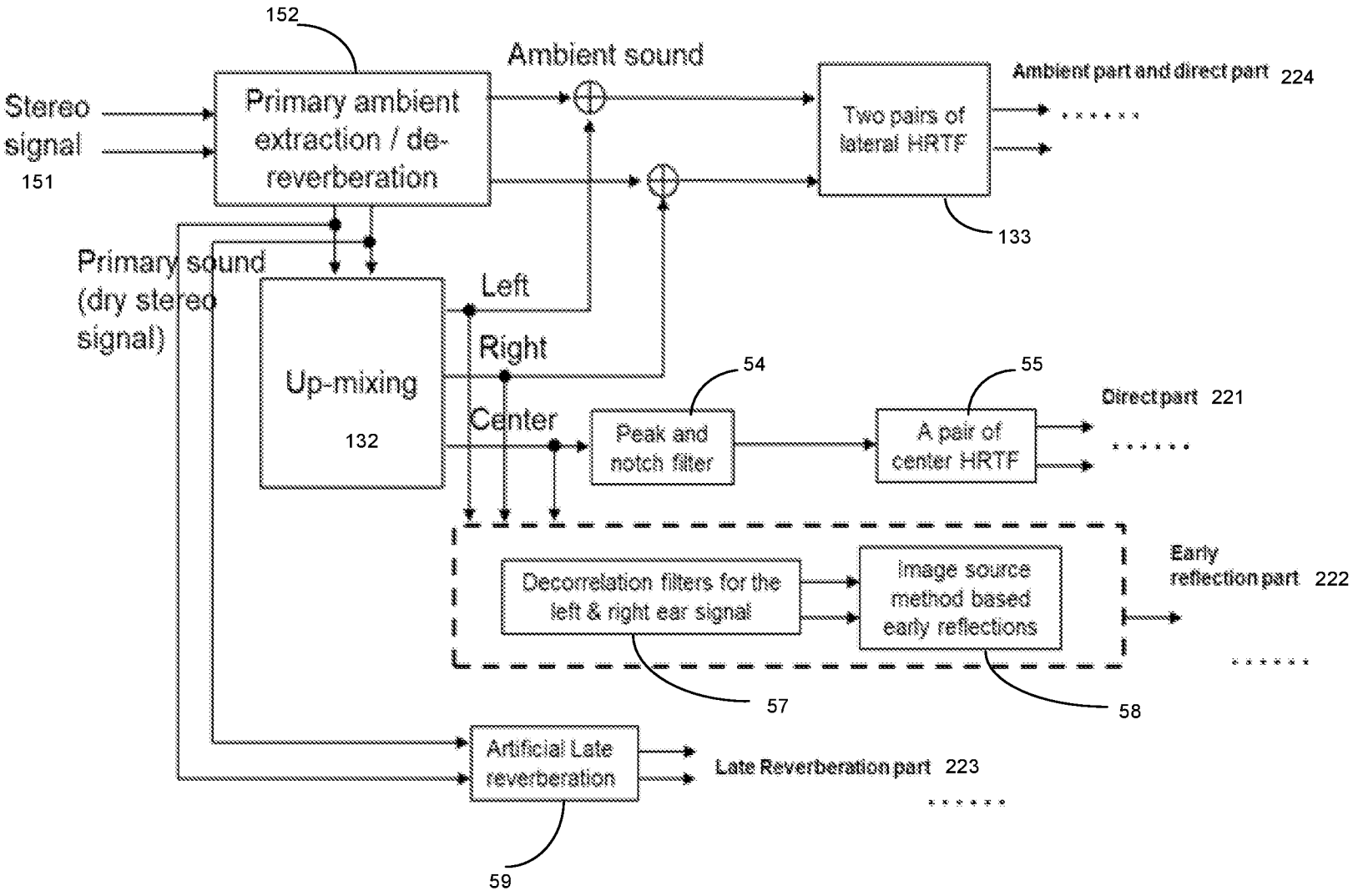
FIG. 16 shows another schematic diagram of a method to enhancement of externalization of a stereo signal according to an embodiment.

FIG. 16 shows an example of a method of enhancing externalization of stereo wet signals with additional room information. A pair of stereo signals 151 is first decomposed 152 into primary and ambient parts. The primary part (primary sound) is up-mixed 132 to center, side (left and right) channel signals. The center channel signal is filtered through the peak and notch filter 54 and further filtered through a pair of center HRTFs 55, e.g., HRTFs at 0°. The ambient sound, and side channel signals for the left and right ears are summed up and further filtered through two pairs of side HRTF 133, e.g., HRTFs at +/−30°. The three up-mixed signals (left, right and center signals) are decorrelated 57 for left and right ears, and further processed to simulate early reflections using the image source method 58. Furthermore, artificial reverberator, measured or synthesized late reverberation 59 is used to simulate the late reverberation part 223 for these three (left, right and center) virtual sound sources. Similar to FIG. 14, the extracted dry stereo signals are directly used to create the late reverberation in FIG. 16. It is also possible to use the upmixed signals (center and side signals) to create the late reverberation. Finally, the left and right ear signals are summed up and played back over headphones.

Embodiment 8

Rendering of Stereo Wet Sound Sources with Local Room Information for AR Application.

Figure 17:
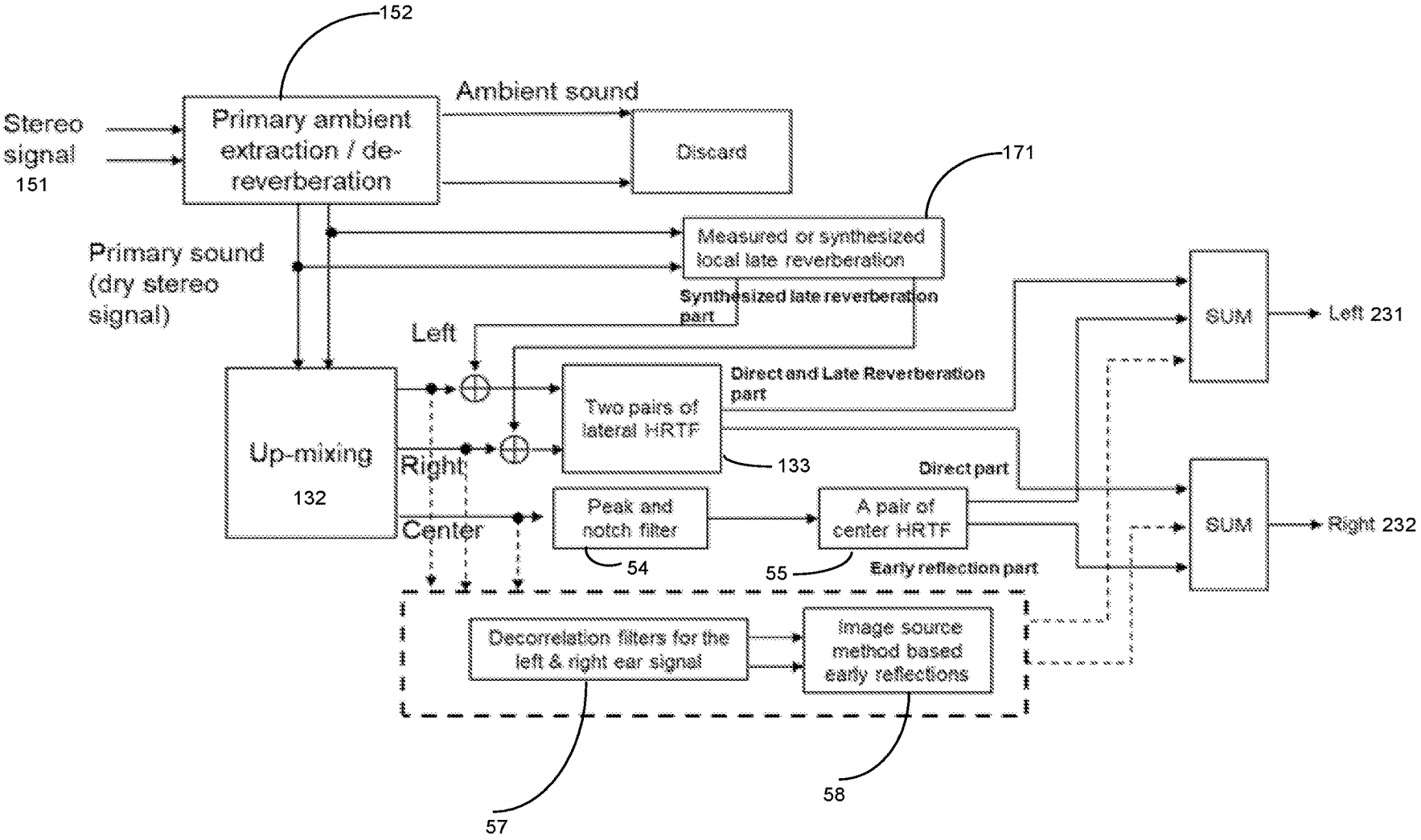
FIG. 17 shows another schematic diagram of a method to enhancement of externalization of a stereo signal according to an embodiment.

FIG. 17 shows an example of a method of enhancing externalization of stereo wet signals with room information for AR application. In this embodiment, the ambient sound is replaced with the local reverberation. A pair of stereo signals 151 is first decomposed 152 into primary and ambient parts. The extracted ambient sound is discard. Only the primary sounds (dry stereo signals) are further processed to virtualization. The primary part is up-mixed 132 to center, side (left and right) channel signals. The center channel signal is filtered through the peak and notch filter 54 to reduce the front-back confusion, and further filtered through a pair of center HRTFs 55, e.g., HRTFs at 0°. The primary sounds are convolved with measured or synthesized local late reverberation 171 and added to the side signals. These signals are further filtered through two pairs of side HRTF 133, e.g., HRTFs at +/−30° to create direct and late reverberation part. The three up-mixed signals (left, right and center signals) are decorrelated 57 for left and right ears, and further processed to simulate early reflections using the image source method 58. The resulting left-ear signal contributions are summed up to produce a left-ear signal 231. Similarly, the resulting right-ear signal contributions are summed up to produce a right-ear signal 232. Finally, the left-ear signal 231 and the right-ear signal 232 may be played back over headphones.

Figure 18:
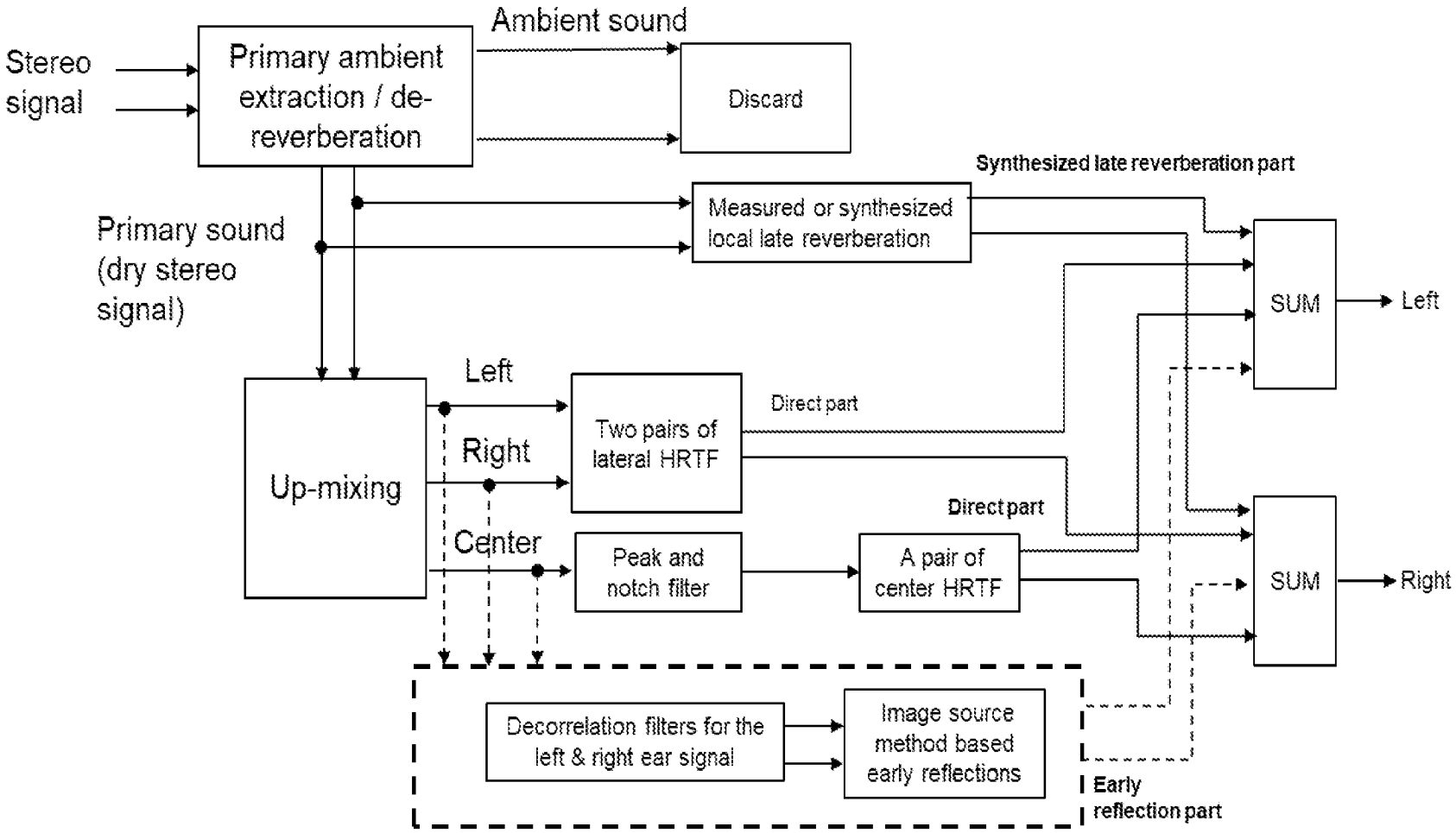
FIG. 18 shows another schematic diagram of a method to enhancement of externalization of a stereo signal according to an embodiment.

Instead of adding the synthesized reverberation part into the side signals, another alternative is to directly add the simulated reverberation part into the left and right ear signals, as shown in FIG. 18.

Applications of embodiments of the disclosure include any sound reproduction system or surround sound system using multiple loudspeakers.

In particular, embodiments of the presented disclosure can be applied to

TV speaker systems,
car entertaining systems,
teleconference systems, and/or
home cinema system, where personal listening environments for one or multiple listeners is desirable.

The foregoing descriptions are only implementation manners and embodiments of the present disclosure, the protection of the scope of the present disclosure is not limited to this. Any variations or replacements can be easily made by a person skilled in the art. The scope of protection of the present application is defined by the attached claims.

The invention claimed is:

1. A method for processing a stereo signal, the method comprising:

obtaining a center channel signal by up-mixing the stereo signal;

generating a filtered center channel signal by applying one or more peak filters and one or more notch filters to the center channel signal;

generating a binaural signal based on the filtered center channel signal;

obtaining a left channel signal and a right channel signal by up-mixing the stereo signal:

convolving the stereo signal with a local reverberation to obtain a convolved stereo signal;

processing the left channel signal and the right channel signal according to two pairs of head related transfer functions to obtain a processed left channel signal and a processed right channel signal;

processing the filtered center channel signal according to a pair of head related transfer functions, to obtain a processed center channel signal;

generating a left signal of the binaural signal based on the processed left channel signal, the convolved stereo signal and the processed center channel signal; and generating a right signal of the binaural signal according to the processed right channel signal, the convolved stereo signal and the processed center channel signal.

2. The method of claim 1, wherein the method further comprises:

obtaining a side channel signal by up-mixing the stereo signal;

processing the side channel signal according to a first head related transfer function, to obtain a processed side channel signal; and processing the filtered center channel signal according to a second head related transfer function, to obtain a processed center channel signal;

wherein the generating the binaural signal based on the filtered center channel signal comprises:

generating the binaural signal based on the processed side channel signal and the processed center channel signal.

3. The method of claim 2, wherein the method further comprises:

filtering the side channel signal and the center channel signal, using one or more decorrelation filters, to obtain a decorrelated side signal and a decorrelated center signal; and obtaining a reflection signal based on the decorrelated side signal and the decorrelated center signal.

4. An apparatus for processing a stereo signal, wherein the apparatus comprises processing circuitry configured to:

obtain a center channel signal by up-mixing the stereo signal;

obtain a filtered center channel signal by applying one or more peak filters and one or more notch filters to the center channel signal; and generating a binaural signal based on the filtered center channel signal, wherein the processing circuitry is further configured to:

obtain a left channel signal and a right channel signal by up-mixing the stereo signal:

convolve the stereo signal with a local reverberation to obtain a convolved stereo signal;

process the left channel signal and the right channel signal according to two pairs of head related transfer functions to obtain a processed left channel signal and a processed right channel signal;

process the filtered center channel signal according to a pair of head related transfer functions, to obtain a processed center channel signal;

generate a left signal of the binaural signal based on the processed left channel signal, the convolved stereo signal and the processed center channel signal; and generate a right signal of the binaural signal according to the processed right channel signal, the convolved stereo signal and the processed center channel signal.

5. The apparatus of claim 4, wherein the processing circuitry is further configured to obtain a side channel signal by up-mixing the stereo signal;

process the side channel signal according to a first head related transfer function, to obtain a processed side channel signal; and process the filtered center channel signal according to a second head related transfer function, to obtain a processed center channel signal;

wherein the binaural signal is generated based on the processed side channel signal and the processed center channel signal.

6. The apparatus of claim 5, wherein the processing circuitry is further configured to:

filter the side channel signal and the center channel signal, to obtain a decorrelated side signal and a decorrelated center signal; and obtain a reflection signal based on the decorrelated side signal and the decorrelated center signal.

7. The apparatus of claim 4, wherein the one or more peak filters comprises:

a first peak filter centered at 4 kHz and having a ⅓-octave bandwidth; and a second peak filter centered at a frequency above 13 kHz and having a ¼-octave bandwidth;

and wherein the one or more notch filters comprises:

a notch filter centered at a frequency between 4 kHz and 8 kHz with 1-octave bandwidth.

8. The apparatus of claim 4, wherein the one or more peak filters comprise a first peak filter centered at 1 kHz and having a ⅓-octave bandwidth, and a second peak filter centered at a frequency between 10 kHz and 12 kHz and having a ¼-octave bandwidth, and wherein the one or more notch filters comprises:

a first notch filter centered at 9 kHz and having a ¼-octave bandwidth, a second notch filter centered at 16 kHz and having a ¼-octave bandwidth.

9. A non-transitory computer-readable storage medium storing program code which, when executed by a computer, causes the computer to carry out operations for processing a stereo signal, the operations comprising:

obtaining a center channel signal by up-mixing the stereo signal;

generating a filtered center channel signal by applying one or more peak filters and one or more notch filters to the center channel signal;

generating a binaural signal based on the filtered center channel signal;

obtaining a left channel signal and a right channel signal by up-mixing the stereo signal:

convolving the stereo signal with a local reverberation to obtain a convolved stereo signal;

processing the left channel signal and the right channel signal according to two pairs of head related transfer functions to obtain a processed left channel signal and a processed right channel signal;

processing the filtered center channel signal according to a pair of head related transfer functions, to obtain a processed center channel signal;

generating a left signal of the binaural signal based on the processed left channel signal, the convolved stereo signal and the processed center channel signal; and generating a right signal of the binaural signal according to the processed right channel signal, the convolved stereo signal and the processed center channel signal.

* * * * *